United States Patent [19]

Ceintrey

[11] 4,439,512

[45] Mar. 27, 1984

[54] CHROMOGENIC COMPOSITIONS CONTAINING STABILIZED PHENOLIC COUPLER COMPOUNDS, RECORDING MATERIALS AND PROCESSES UTILIZING SAME

[75] Inventor: Claude Ceintrey, Paris, France

[73] Assignee: La Cellophane, Paris, France

[21] Appl. No.: 442,782

[22] Filed: Nov. 18, 1982

Related U.S. Application Data

[60] Division of Ser. No. 215,067, Dec. 10, 1980, abandoned, which is a continuation of Ser. No. 911,718, Jun. 2, 1978, abandoned, which is a continuation-in-part of Ser. No. 905,360, May 12, 1978, abandoned, which is a continuation-in-part of Ser. No. 747,976, Dec. 6, 1976, abandoned.

[30] Foreign Application Priority Data

Dec. 5, 1975 [FR] France ..... 75 37228

[51] Int. Cl.[3] ..... G03C 1/52

[52] U.S. Cl. ..... 430/180; 430/181; 430/171; 430/150; 430/151; 430/149; 430/338; 430/345; 430/336; 430/341; 430/170; 428/913; 106/21; 346/205; 346/225

[58] Field of Search ..... 430/180, 181, 171, 150, 430/151, 149, 338, 345, 336, 341, 182, 170; 428/411, 913; 282/27.5; 106/21

[56] References Cited

U.S. PATENT DOCUMENTS

| | | | |
|---|---|---|---|
| T905004 | 12/1972 | King | 430/180 |
| 2,663,654 | 12/1953 | Miller et al. | 428/913 |
| 3,094,417 | 6/1963 | Workman | 430/495 |
| 3,346,571 | 10/1967 | Spatz et al. | 260/240 |
| 3,451,338 | 6/1969 | Baum | 430/345 |
| 3,483,013 | 12/1969 | Berg et al. | 428/913 |
| 3,539,375 | 11/1970 | Baum | 428/913 |
| 3,542,775 | 11/1970 | Smith | 260/240 |
| 3,674,535 | 7/1972 | Blose et al. | 260/41 C |
| 3,964,911 | 6/1976 | Robillard | 430/177 |
| 4,097,288 | 6/1978 | Lawton | 106/21 |
| 4,289,839 | 9/1981 | Di Pippo | 430/180 |

FOREIGN PATENT DOCUMENTS 975457 11/1964 United Kingdom .
975456 11/1964 United Kingdom .

OTHER PUBLICATIONS

Kirk-Othmer, Encyclopedia of Chemical Technology, vol. 12, John Wiley & Sons, Inc., 1967, p. 48.

*Primary Examiner*—Won H. Louie, Jr.
*Attorney, Agent, or Firm*—Sherman & Shalloway

[57] ABSTRACT

Phenylurethane compounds formed by the reaction between a phenolic coupler compound and an organic isocyanate compound are utilized to form phenolic coupler compounds in situ in order to react with chromogenic compounds present in the sensitive layer of recording or reproducing materials.

The phenolic coupler compounds can also be stabilized by blocking the phenolic hydroxyl with carbonate, an alkyl ether, organosilylated ether or organophosphoric acid ester, some of which are novel compounds. These stabilized derivatives of the stabilized phenolic coupler compound will decompose by application to sufficient thermal energy or suitable liquid or gaseous fluid to form the phenolic coupler compound in situ. The phenolic coupler compound is formed in situ by applying thermal energy to the sensitive layer or by applying to the sensitive layer a liquid or gaseous fluid which is able to decompose the stabilized phenolic coupler compound and release the phenolic coupler compound.

Preferred chromogenic compounds include spiropyrans, triphenylmethane derivatives, ferric salts, non-photosensitive silver salts and diazonium compounds. Use in a diazo process is particularly beneficial. Sensitive recording materials of greatly improved shelf-life are provided. The compositions and recording or reproducing materials have applicability to photosensitive and thermosensitive systems and in dry, semi-dry and wet development processes.

23 Claims, No Drawings

CHROMOGENIC COMPOSITIONS CONTAINING STABILIZED PHENOLIC COUPLER COMPOUNDS, RECORDING MATERIALS AND PROCESSES UTILIZING SAME

RELATED CASES

This application is a division of application Ser. No. 215,067, filed Dec. 10, 1980, which in turn is a continuation of application Ser. No. 911,718, filed June 2, 1978 which in turn is a continuation in part of copending application Ser. No. 905,360, filed May 12, 1978, titled "CHROMOGENIC COMPOSITIONS; RECORDING MATERIALS AND PROCESSES UTILIZING SAME" which in turn is a continuation in part of application Ser. No. 747,976, filed Dec. 6, 1976, all now abandoned.

BACKGROUND OF THE INVENTION

1. Field of the Invention

The present invention relates to photosensitive and/or thermosensitive chromogenic compositions, recording or reproduction materials utilizing these sensitive compositions and processes for producing colored images utilizing these materials. More particularly, the present invention relates to compositions for producing colored images wherein the reaction between a sensitive chromogenic compound (including the dissociation or decomposition or isomerization product of the sensitive chromogenic compound) with a phenolic coupler compound is responsible for the formation of colored images.

2. Discussion of the Prior Art

The use of photosensitive compounds and compositions and thermosensitive compounds and compositions that change color or intensity or form color reactive compounds when exposed to light and/or heat, have long been used in light sensitive and heat sensitive compositions used in forming colored images and reproductions. For example, on exposure to light of certain wavelengths, photochromic compounds undergo a reversible color change; i.e., they become colored under the influence of light of certain wavelengths, whereas upon irradiation with other, usually longer wavelengths, they exhibit a tendency to revert to the colorless state. While the reversibility of the color change of photochromic and thermochromic compounds and compositions have been taken advantage of in various processes, such as photography or photolithography, the reversibility of the color change has prevented the use of such substances in compositions and processes wherein it is desired to produce a permanent image. Accordingly, the prior art has developed several approaches to provide permanent colored images utilizing photochromic and thermochromic compounds. One commonly accepted and often successful approach has been to provide compositions wherein a photosensitive or thermosensitive chromogenic compound is caused to undergo an irreversible chemical reaction to form a permanent colored image subsequent to exposure to light and/or heat.

Particularly useful chromogenic compounds and compositions which have been used in this type of system include those chromogenic compounds which are capable of reacting with a phenolic compound to produce a permanent colored image.

One class of chromogenic compounds which has been found to be particularly useful in its ability to form permanent colored images by combining with a phenolic compound is the class of spiropyran compounds. For example, Baum, in U.S. Pat. No. 3,451,338, describes a thermographic method of data-recording and heat-sensitive record sheets which include chromogenic indolinospirobenzopyran compounds and di-phenol material which produce immediate and lasting color when and where the two co-reactant materials are brought into liquid contact. Generally, the liquid environment is the result of the application of heat which results in the melting of one or both of the co-reactant materials or a polymeric film binder.

The chromogenic properties of triphenylmethane derivatives are also well known and have been utilized in various sensitive compositions and recording materials. For instance, Baum, in U.S. Pat. No. 3,539,375, describes a modification of his earlier thermographic recording system wherein the chromogenic material is crystal violet lactone where the lactone and phenolic reactant are dispersed in a matrix of polyvinyl alcohol. Similar heat sensitive record materials have been described in Blose, et al., U.S. Pat. No. 3,674,535 and French Patent No. 2,172,386.

Various ferric salts, especially ferric salts of organic acids, such as those disclosed in U.S. Pat. No. 2,663,654, to Miller, et al. have also been known as chromogenic compounds which form colored images upon reaction with phenolic compounds.

One of the oldest recording systems utilizing the reaction between phenolic compounds and photosensitive compounds for producing color reactions is in the field of diazo-reproduction. Diazo processes have been long used for reproducing blueprints and in reproduction of high-resolution microfilm. The basic diazo process used in blueprint reproduction processes as well as in microfilm reproduction processes includes dissociation of a diazonium salt by irradiation with ultraviolet light followed by the reaction of the unirradiated salts with phenolic or amine-type reactants so as to produce an azo dye capable of forming contrast in the image reproduction. The reaction between the diazonium salt and phenolic or amine-type reactants is referred to as a coupling reaction. In the present specification, the term "coupling reaction" will be used to refer to any reaction between a phenolic "coupling" compound and a chromogenic compound which yields a colored reaction product. French Patent No. 1,336,307 provides one example of a coupling reaction utilizing recording materials containing diazonium compounds which react with free phenolic compounds to create colored images.

However, the development of these processes utilizing the reaction between a phenolic compound and a photosensitive or thermosensitive chromogenic compound have met with various drawbacks which have limited their widespread usage. For instance, the phenolic compounds are readily oxidized by air giving colored quinone compounds which tend to produce a disagreeable background color. There has also been a tendency for premature color reactions between the phenolic compounds and the chromogenic compounds. These drawbacks have resulted in unsatisfactory shelf lives for the sensitive recording materials utilizing these sensitive compositions. In addition, the colored images have not yet proven to be permanently irreversible in many instances.

As one attempt to solve this deficiency, it has been known to encapsulate the co-reactant materials. However, such technique, itself, presents difficult procedures in the formation of the encapsulated product and the resulting products are often fragile and limited in storage life. Moreover, various of the techniques which have been utilized to stabilize the phenolic coupling compounds in order to prevent them from reacting prematurely or causing disagreeable heightening of the background of the sensitive recording material have not proved successful since they resulted in undesirable lowering of the reaction speed during the actual recording process.

SUMMARY OF THE INVENTION

It has now been found that these drawbacks of the prior art can be eliminated by providing light and/or heat sensitive recording or reproduction materials in which the phenolic coupler compound is produced in situ by the decomposition of a stabilized phenolic coupler compound in which the hydrogen atom of the phenolic hydroxyl radical is blocked from reaction by a chemical blocking agent.

Accordingly, the present invention provides chromogenic compositions wherein the color producing reactants are a chromogenic compound which is capable of reacting with a phenolic coupler compound to form a colored reaction product and a hydroxyl group-blocked stabilized phenolic coupler compound which is the reaction product of a phenolic coupler compound and a hydroxyl group reactive compound capable of replacing the hydrogen atom of each phenolic hydroxyl group of the phenolic coupler compound, the stabilized phenolic coupler compound being non-reactive to the chromogenic compound and which is capable of producing, by decomposition in situ, the phenolic coupler compound.

The present invention further provides recording and reproduction materials in which a suitable support is coated with a sensitive layer containing the chromogenic composition; the stabilized phenolic coupler compound can be present in the same layer as the chromogenic compound or in a separate layer adjacent to the layer containing the chromogenic compound.

The present invention further provides a process for forming colored images which can be reproductions of original images or original recordings of information in which the recording or reproduction material containing the sensitive layer which includes the chromogenic composition of the present invention is exposed to sufficient thermal energy to cause the decomposition of the stabilized phenolic coupler compound and allowing the resulting phenolic coupler compound to react with the chromogenic compound to form a colored reaction product. In an alternate mode of the process of the present invention, decomposition of the stabilized phenolic coupler compound is caused by the application of a gaseous or liquid fluid which is capable of causing the decomposition of the stabilized phenolic coupler compound into the phenolic compound and the organic hydroxyl blocking compound, for example, an organic isocyanate.

In a particular embodiment of the process of the present invention, the chromogenic compositions are utilized in a diazo-type process in which the sensitive layer of the recording material is first exposed through an original transparency to ultraviolet radiation thereby decomposing the diazonium compound in the sensitive layer in areas corresponding to the transparent non-image areas of the original, and thereafter the recording material is exposed to thermal energy or a gaseous or liquid fluid capable of causing the decomposition of the stabilized phenolic coupler compound whereby the remaining diazonium compound in those areas corresponding to the translucent or opaque image areas of the original which were not decomposed by the irradiation with ultraviolet light are caused to react with the phenolic coupler compound thereby producing a positive reproduction of the original.

In another aspect, the present invention provides a process for recording information on a recording material comprising a support and a sensitive layer containing the chromogenic composition of the present invention wherein the information, generally in the form of lines, dots, letters, numerals, and the like, are directly recorded on the recording material by contacting the sensitive layer with a heated stylus, hot type or similar means for applying thermal energy in accordance with the information to be recorded whereby stabilized phenolic coupler compound, which is present in the same or an adjacent layer, decomposes and the coupling reaction between the chromogenic compound and the phenolic coupler compound takes place.

The chromogenic compositions of the present invention can also include any of the conventional binders generally used with chromogenic compositions.

When an organic isocyanate is used as the blocking agent to form a normally stable phenylurethane by reaction with the phenolic coupler compound, it is preferred to also include materials which will react with the isocyanate produced as a result of the decomposition of the phenylurethane in order to prevent the isocyanate compound from escaping to the ambient environment or otherwise adversely affecting the colored images.

The chromogenic compositions and recording materials of the present invention can also include decomposition catalysts to lower the decomposition temperature of the stabilized phenolic coupler compound.

DESCRIPTION OF THE INVENTION AND PREFERRED EMBODIMENTS

The stabilized phenolic coupler compounds useful in the present invention are normally very stable compounds and thereby provide chromogenic compositions and recording or reproduction materials utilizing sensitive layers containing the chromogenic compositions which are themselves highly stable and exhibit extremely long storage lives and a greatly increased resistance to the phenomena of aging.

Generally any hydroxyl blocking reactant which is capable of replacing the hydrogen of each phenolic hydroxyl group of the phenolic coupler compound to form a phenolic coupler complex (stabilized phenolic coupler compound) which is non-reactive to the chromogenic compound, will not decompose at room temperature or at slightly higher temperatures up to about 55° C. (the highest temperature likely to be encountered even under the most severe storage conditions), but will decompose under application of suitable thermal energy or upon application of suitable basic gaseous or liquid fluids to form the phenolic coupler compound and the hydroxyl blocking reactant can be used for purposes of the present invention. Suitable blocking agents (which may also be referred to as hydroxyl protective groups) include, for example, organic isocyanates, carbonate (which may take the form of a linking radical between two or more phenolic coupler compounds, for example,

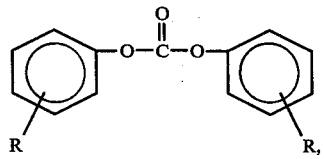

or as a cyclic carbonate structure, for example,

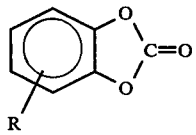

in the case of dihydroxy phenolic coupler compounds in which the hydroxyl radicals are on adjacent ring carbon atoms or at most on para-carbon atoms of the aromatic ring), alkyl (preferably straight chain), organosilyl compounds and organophosphoric acid compounds. These blocking reagents form, respectively phenylurethanes, carbonate derivatives of the phenolic coupler compound, alkyl ether of the phenolic coupler compound, organosilylated ether of the phenolic coupler compound and organophosphoric acid ester of the phenolic coupler compound.

Any phenolic compound which can couple with the chromogenic compound to form a colored reaction product can be used in the present invention. Generally, the benzene mono-, or di- or tri-phenols or mono- or di-hydroxyl naphthalenes or derivatives thereof which are coupler compounds for the chromogenic compound can be used as the phenolic coupler compounds. For example, any of the phenolic compounds listed in columns 3–8 of the abovementioned patent to Baum, U.S. Pat. No. 3,451,338, the disclosure of which is herein incorporated by reference, or any of the conventional phenolic couplers used in the diazo-type reproduction processes, such as the compounds disclosed in U.S. Pat. No. 3,725,066 to Nihyakumen, et al., the disclosure of which is herein incorporated by reference, can be used as the phenolic compounds in the present invention. Because of their ready availability, preferred phenolic compounds include phenol, resorcinol, pyrogallol, 2,3-dihydroxynaphthalene, 4,4'isopropylidene diphenol, etc.

The various preferred forms of the stabilized phenolic coupler compounds and chromogenic compositions and recording or reproducing materials will now be described in detail.

PHENYLURETHANES

To phenylurethanes are themselves known compounds obtained by the reaction between an organic isocyanate and a phenolic compound according to the generalized reaction equation:

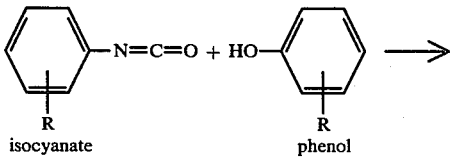

-continued

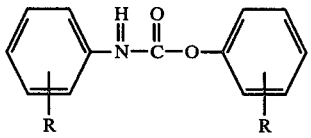

The phenyl urethane compounds are described, for example, in Saunders and Frish's "High Polymers", Vol. XVI and in Kirk and Othmer's "Encyclopedia of Chemical Technology", Vol. XII.

The above reaction is carried out in an anhydrous, inert solvent in the presence of a known catalyst, such as triethylamine. The reaction mixture is then filtered, washed and dried to obtain the phenylurethane reaction product.

Any organic isocyanate which is capable of reacting with the phenolic coupler compounds are suitable for use in the present invention. The particular isocyanate compound is not critical and it is therefore advantageous to use the simplest and most readily available organic isocyanate compounds. Suitable isocyanate compounds include, for example, phenyl isocyanate, tolylene di-isocyanate, 1,5-naphthalene di-isocyanate, 4,4-diphenylmethane di-isocyanate, 1,6-hexamethylene di-isocyanate, and the like.

The isocyanate produced by the decomposition of the phenylurethane compound is preferably prevented from volatizing or remaining in the free form by incorporating a substance having free OH groups other than the phenolic coupler compound that can react with the isocyanate but which is inert to the chromogenic compound. Examples of such optional ingredient include aliphatic alcohols, hydroxy polyethers, hydroxy polyesters and the like. These compounds are useful because they prevent volatization of free isocyanates, which may be toxic, and they facilitate the decomposition of the phenylurethane by heat.

Preferred hydroxy compounds include butanediol, ethylene glycol, diethylene glycol or products sold under the trademark DESMOPHEN by Bayer, e.g. DESMOPHEN 250U, DESMOPHEN 550U, DESMOPHEN 800, DESMOPHEN 850, and the like.

The amount of the optional hydroxyl-group containing reactant is selected to provide a stoichiometric excess of the hydroxyl group compound over isocyanate compound.

In order to lower the temperature at which the phenylurethane compound decomposes, generally the range of about 80° C. to about 200° C., it is advantageous to include with the sensitive layer, preferably as a separate layer immediately adjacent to the layer containing the phenylurethane compound, a decomposition catalyst.

As examples of suitable decomposition catalysts there can be mentioned the following: ammonia or compounds capable of generating ammonia by heat, for example, urea, thiourea and their derivatives, ammonium salts such as ammonium carbonate, ammonium benzoate, etc. and salt couples which by reaction to heat produce ammonia, such as the product couples described in French Patent No. 1,403,004 (strong acid ammonium salt and metal compound) or the product couples described in French Patent No. 1,418,156 (strong acid and weak base salt and weak acid and strong base salt); inorganic bases such as soda, potash, etc.; aliphatic amines, preferably tertiary amines of the formula

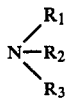

wherein $R_1$, $R_2$ and $R_3$ can be the same or different and are each alkyl or alkylene of from 1 to 10 carbon atoms, such as triethylamine, etc.; aliphatic tertiary polyamines such as hexamethylene tetramine, triethylene diamine, etc.; organic or inorganic ammonium salts, such as carbonates, hydrocarbonates, acetates, formates, oxalates, benzoates, etc.; metal salts of organic acids such as tin, calcium, lead, zinc and aluminum, salts of organic acids having from 3 to 18 carbon atoms, preferably 5 to 10 carbon atoms, especially lead octoate, zinc octoate, calcium naphthenate, etc.; organostannic salts, such as dilauryl dibutyl tin, etc., morpholine derivatives, such as morpholine, N-methyl morpholine, 2,6-dimethylmorpholine, N-aminoethyl morpholine, etc., and hydroxylated amines (or amino alcohols) such as mono-, di- or tri-ethanolamine, 2-amino-1-butanol, tri (hydroxymethyl) aminoethane, etc.

Preferred decomposition catalysts include thiourea, ammonium carbonate, triethylamine diamine, calcium naphthenate, calcium octoate, lead naphthenate, dilauryl dibutyl tin, and the like.

The amount of the decomposition catalyst is not especially critical but will generally be within the range of 0.1% to 10% by weight of phenylurethane compound. However, care should be taken to avoid using the catalyst in amounts which will lower the decomposition temperature to below about 40° C., especially below about 60° C.

CARBONATE DERIVATIVES, ALKYL ETHER DERIVATIVES, ORGANOSILYLATED ETHER DERIVATIVES AND ORGANOPHOSPHORIC ACID ESTER DERIVATIVES OF THE PHENOLIC COUPLER COMPOUNDS

In a general manner these classes of stabilized phenolic coupler compound have the phenolic hydroxyl group (the hydroxyl group attached directly to an aromatic ring carbon atom) protected in the form of a carbonate

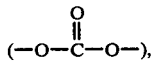

alkyl ether ($-O-C_nH_{2n+1}$), organosilylated ether ($-O-Si-R$) or organophoshoric acid ester

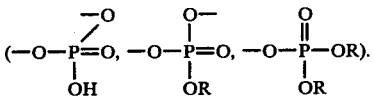

For example, the stabilized phenolic coupler compound can generically be described by the following formula

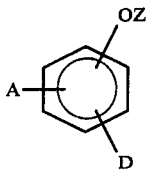

wherein A is a hydrogen atom, an alkyl group of from 1 to 8 carbon atoms, an alkylene group of from 2 to 8 carbon atoms, an aryl group, an arylalkyl group wherein the alkyl has from 1 to 6 carbon atoms, or a blocked hydroxyl group of the formula $-OX_1$, wherein $X_1$ is as defined below, or the group

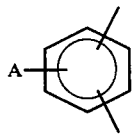

may represent a naphthyl group

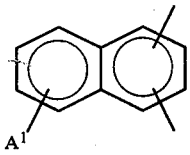

wherein $A^1$ represents a hydrogen atom, an alkyl group of 1 to 4 carbon atoms, an alkenyl group of 2 to 4 carbon atoms or the group G, wherein G represents a hydrogen atom, a sulfonic group, or a sulfonate of ammonium or an amine and represented by the formula:

$$+SO_3^-, EH^+]$$

wherein E represents ammonia or a primary, secondary or tertiary aromatic or aliphatic amine; D is a hydrogen atom, an alkyl group of 1 to 8 carbon atoms, an alkylene group of 2 to 8 carbon atoms, an aryl group, an arylalkyl group in which the alkyl has from 1 to 4 carbon atoms or a blocked hydroxyl group of the formula $-OX_2$, wherein $X_2$ is as defined below; and Z, $X_1$, and $X_2$, which may be the same or different are selected from the group consisting of

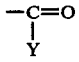

where Y is a valence bond together with A or D, a straight chain alkyl group of from 1 to 5 carbon atoms, an organosilyl compound or a mono-, di- or tri-functional organophosphoric acid compound.

These stabilized hydroxyl group blocked compounds will be described with greater particularity in connection with 2,3-dihydroxy naphthalene of the following formula:

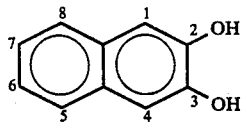

as the phenolic coupler compound in view of the very favorable properties of this coupler compound, including its very high reactivity, especially in diazo reproduction processes.

The preferred stabilized phenolic coupler compounds for use in this invention are derivatives of 2,3-dihydroxynaphthalene (naphthalene-2,3-diol) of the following formula (I)

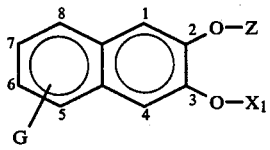

(I)

wherein

G represents a hydrogen atom, a sulfonic group or a sulfonate of ammonium or an amine and is represented by the formula:

$$[SO_3^-, EH^+]$$

in which E represents ammonia or a primary, secondary or tertiary aromatic or aliphatic amine; Z represents a radical of the following formulas (IIa) or (IIb) or (IIc)

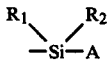

(IIa)

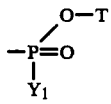

(IIb)

or $$-C_nH_{2n+1} \quad \text{(IIc)}$$

wherein n is an integer of from 1 to 5 and when Z represents a radical of formula (IIa) then A is a radical $R_3$ selected from the group consisting of a straight or branched alkyl or alkenyl group of from 1 to 6 carbon atoms which may be substituted by at least one substituent selected from the group consisting of a chlorine atom, a nitrile group, phenyl and alkyl phenyl in which the alkyl has from 1 to 4 carbon atoms; and, $X_1$ is a triorganosilyl radical of the formula

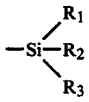

wherein $R_1$, $R_2$ and $R_3$ may be the same or different, and $R_1$ and $R_2$ have the same meaning as $R_3$; or $X_1$ and A may be linked together to form a divalent radical of the following formula (Va), (Vb) or (Vc):

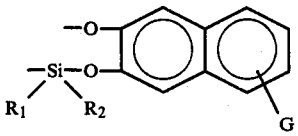

(Va)

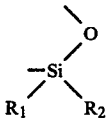

(Vb)

or

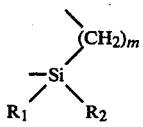

(Vc)

in which the silicon atom is linked to the oxygen atom at the 3-position of the naphthyl group; $R_1$ and $R_2$ may be the same or different and are as defined above, with the proviso that when there is more than one G group in the molecule they are identical, and m is 1, 2 or 3; when Z represents a radical of formula (IIb) then $X_1$, $Y_1$ and T are defined according to (A), (B) or (C):

(A) $Y_1$ represents a radical OR in which R is a branched or straight alkyl of from 1 to 8 carbon atoms or the group $[O^-, EH^+]$ where E is as previously defined, T has the same meaning as R or ammonia, and $X_1$ is a radical of the formula:

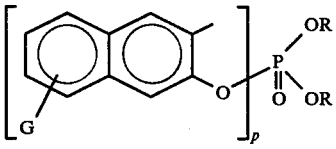

wherein p is 0, 1, 2 or 3 and G and R have the previously given definitions, with the provisos that when there is more than one G group in the molecule they are identical; when one OR group is an oxyammonium group the other OR group is identical and G is a hydrogen atom or a sulfonate group $-SO_3^-, EH^+]$ with the $EH^+$ group representing the identical radical;

(B) T is a radical OR' wherein R' is a hydrogen atom or the radical R as previously defined, and $Y_1$ and $X_1$ together form a divalent radical of the following formula:

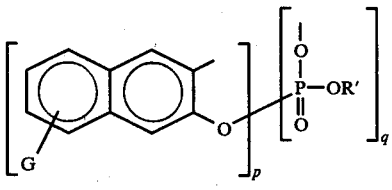

wherein p is 0, 1, 2 or 3, q is 0 or 1 and G and R' are as defined above, with the provisos that when q is 1, the atoms of phosphorous are bound by an oxygen atom: when p and q are both 0, $X_1$ and $Y_1$ form a valence link;

when there is more than one G group in the molecule they are identical; all radicals OR' in the molecule are identical to each other and when OR' represents an oxyammonium group, the group G is a hydrogen atom or a sulfonate group $-SO_3^-,EH^+]$ in which all $EH^+$ radicals are identical; or (C) T is a radical of the following formula ($IIb_3$)

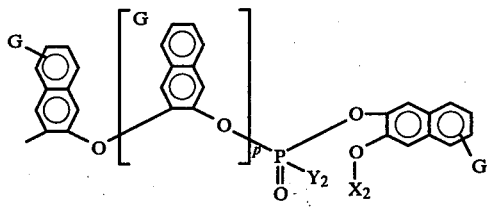

(IIb3)

wherein p and G are as defined above; $X_2$ and $Y_2$ together form a valency link, and $X_1$ and $Y_1$ form a valency link; or $Y_1$ and $Y_2$ together form a radical of the following formula ($IIb_4$):

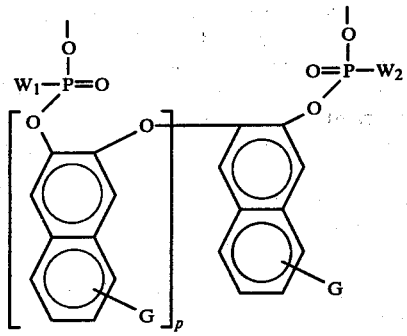

(IIb4)

in which the groups $W_1$ and $X_1$ and $W_2$ and $X_2$ each represent a valency link; and when Z represents a radical of formula (IIc) then $X_1$ also represents the same radical of formula (IIc); or Z and $X_1$ together form the radical >C O.

ORGANOSILYLATED ETHERS OF 2,3-DIHYDROXY NAPHTHALENE

These are the compounds of formula (I) in which Z represents an organosilane radical of formula (IIa)

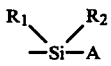

(IIa)

The preferred organosilane ethers are compounds represented by the following formulas (Ia), (Ib), (Ic), (Id) and (Ie):

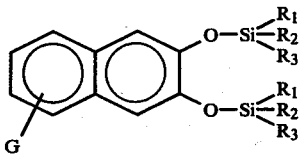

(Ia)

-continued

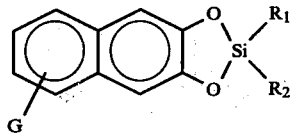

(Ib)

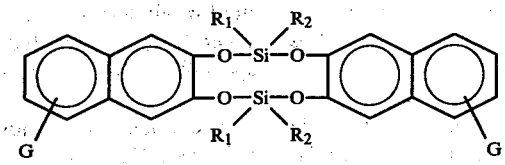

(Ic)

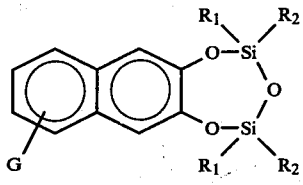

(Id)

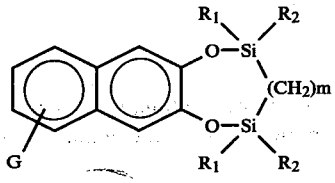

(Ie)

wherein G, $R_1$, $R_2$, $R_3$ and m have the previously given definitions in connection with formula (I).

The preferred organosilane ethers are those in which G is a hydrogen atom and $R_2$, $R_2$ and $R_3$, which may be the same or different, represent a hydrogen atom, methyl, ethyl, chloromethyl, cyanoethyl, phenyl, and tolyl and where m is either 1 or 2. Compounds in which $R_1$, $R_2$ and $R_3$ are each a methyl group are especially preferred.

These organosilane ethers can be prepared by the following conventional procedures used in the synthesis of organosilane compounds.

Silylated Derivatives in Which G is H or $SO_3H$

Silylated ethers of formula (Ia)

The compounds of formula (Ia) can be prepared by reacting the 2,3-dihydroxynaphthalene in an anhydrous solvent which is inert to the reactants as well as to the silylated ether of the phenolic coupler compound with approximately stoichiometric proportions of an organosilane compound containing a triorganosilane group of the formula

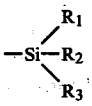

for example, a chlorosilane of the formula $ClSiR_1R_2R_3$.

Silylated ethers of formulas (Ib) and (Ic)

These compounds can be obtained by reacting in an anhydrous inert solvent, 2,3-dihydroxynaphthalene and a dichlorosilane having the formula $Cl_2SiR_1R_2$. The compounds (Ib) and (Ic) will be formed in equilibrium with each other. These compounds can be separated from each other by distillation. At ambient temperature the compound of formula (Ib) will slowly form its dimer of formula (Ic).

Silylated ethers of formulas (Id) and (Ie)

These compounds can be obtained by reaction between the phenolic coupler and a dichlorosiloxane of the formula

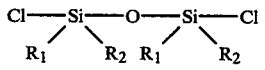

or a dichlorosilylalkene of the formula

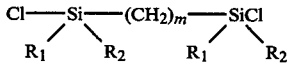

respectively, in an inert anhydrous solvent.

ORGANOPHOSPHORIC ACID ESTERS OF 2,3-DIHYDROXYNAPHTHALENE

These are the compounds of formula (I) in which Z represents a mono- or polyfunctional phosphoric acid group of the formula (IIb)

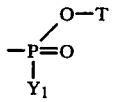

(IIb)

The preferred organophoric acid esters are compounds represented by the following formulas (If), (Ig), (Ih), (Ii), (Ij) and (Ij'):

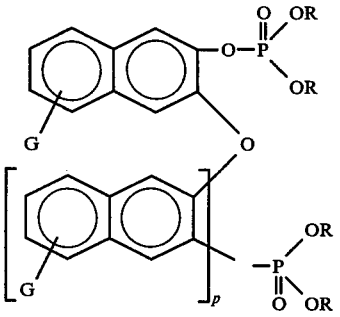

(If)

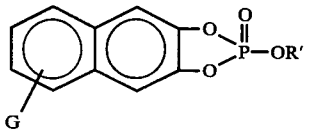

(Ig)

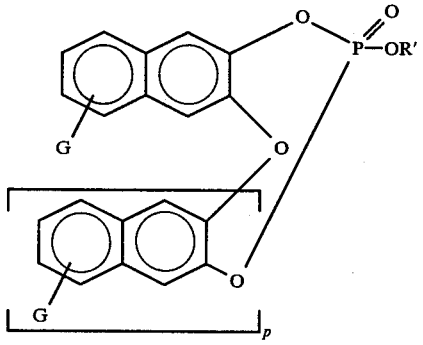

(Ih)

-continued

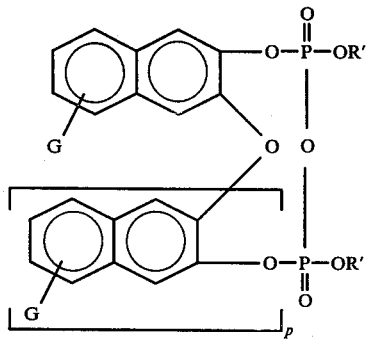

(Ii)

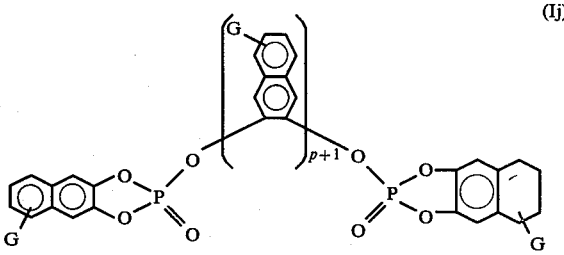

(Ij)

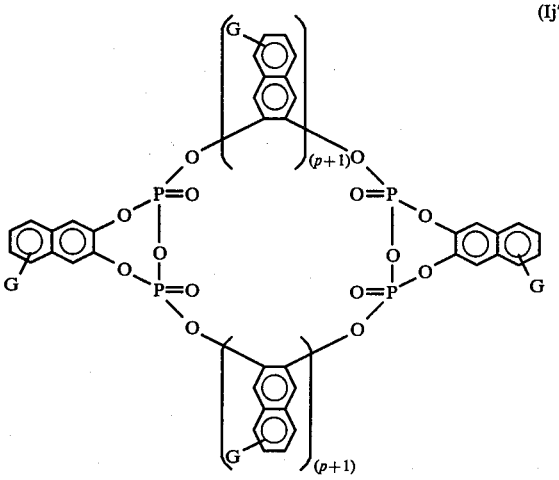

(Ij')

The preferred organophosphoric acid compounds are those in which G is a hydrogen atom and R is a straight or branched alkyl group containing 1 to 4 carbon atoms or an oxyammonium radical derived from ammonia or from a tertiary aliphatic mono- or polyamine.

For convenience these phosphorus containing compounds can be classified according to whether the phosphoric acid hydroxyl group block compound contains one, two or three functional groups, for example, polyphosphoric and phosphoric anhydride, $P_2O_5$, $POCl_3$, $PCl_3$, $POCl_2(OR)$, $PCl_2(OR)$, $POCl(OR)_2$, etc.

Class A—Monofunctional phosphorous compounds

Phosphoric acid esters of formula (If)

The compounds of formula (If) exist, in general, in the form of a mixture of products which only differ as to their p values and their distribution. They can be separated by crystallization. Preferably, R is an alkyl radical, straight or branched, having 1 to 4 carbon atoms or an oxyammonium radical.

Phosphoric compounds of formula (If) in which G is hydrogen or $SO_3H$ and R is an alkyl group These compounds can be prepared by reacting 2,3-dihydroxynaphthalene with a monofunctional phosphorous compound of the formula $ClPO(OR)_2$, in which R is an alkyl group.

In accordance with the proportions of the reactants being used, a mixture of compounds corresponding with the formula (If) but differing in the value of p is obtained. By recrystallization treatments, the (If) compounds corresponding to a single value of p can be isolated.

Phosphorus Compounds of Formula (If) in which G is Hydrogen or a Sulfonate Group and OR represents an Oxyammonium Group The corresponding compounds are obtained by the reaction of a previously-defined (If) compound (with G representing an atom of hydrogen or a sulfonic group) with ammonia or an appropriate amine working either in solution or in aqueous suspension or in an inert organic solvent and under moderate temperature conditions (in general, lower than 100°). It is advantageous to operate at ordinary temperature.

Class B—Difunctional Phosphorous Compounds
Phosphoric Acid Esters of Formulas (Ig), (Ih) and (Ii)

The preferred compounds of this group are those in which R' is a hydrogen atom, a straight or branched alkyl group of 1 to 4 carbon atoms or an oxyammonium group, as previously defined. It should be noted that when p is 0 the compound of formula (Ih) has the formula (Ig).

Phosphorus Compounds of the Formulas (Ig), (Ih) and (Ii) in which G is Hydrogen or an $SO_3H$ Radical and R is an Alkyl Group The various esters (Ig), (Ih) and (Ii) can be obtained by reacting the naphthalene-diol-2,3 with the difunctional compounds containing phosphorus having the following formula:

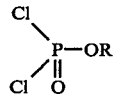

where R represents an alkyl group.

The (Ig), (Ih) and (Ii) compounds are obtained in varying proportions in accordance with the proportion of reactants and the method of introduction of those reactants.

Phosphorus Compounds with the Formulas (Ig), (Ih) or (Ii) in which G is Hydrogen or a Sulfonate Group and where OR' represents an Oxyammonium Group These compounds are obtained by the reaction of a (Ig), (Ih) or (Ii) compound as defined previously (with G being an atom of hydrogen or a sulfonic group and R being an alkyl group) with ammonia or an appropriate amine, working either in solution or aqueous suspension or in solution in an inert organic solvent and under moderate conditions of temperature (in general, lower than 100°). It is advantageous to work at ambient temperature.

One can also obtain such organophosphoric ester compounds by reacting 2,3-dihydro-naphthalene with the oxychloride of phosphorus $POCl_3$. Thus, in the first stage, compounds similar to those with the formulas (Ig), (Ih) and (Ii) are prepared, but they are compounds whose formulas contain an atom of chloride in place of the radical OR.

In the second stage, the first stage products are reacted with ammonia or amine and obtain the expected organophosphorated compounds.

Phosphorus Compounds of the Formulas (Ig), (Ih) or (Ii) in which G is Hydrogen or a Sulfonic Group and where OR' is a Hydroxyl Group These compounds are obtained by hydrolysis of an ester with the formula (Ig), (Ih) or (Ii) in which G is an atom of hydrogen or a sulfonic group and R is an alkyl group. After hydrolysis, the (Ig), (Ih) and (Ii) compounds can be isolated, once they are mixed, by appropriate recrystallization treatments.

These compounds containing phosphorus can also be obtained by making naphthalene-diol-2,3-react with the oxychloride of phosphorus $POCl_3$. Thus, in the first stage, compounds similar to those with the formulas (Ig), (Ih) and (Ii) are prepared, but they are compounds whose formulas contain an atom of chlorine in place of the radical OR'.

In the second stage, the compounds containing phosphorus obtained in the first stage are hydrolyzed cold and compounds with the formulas (Ig), (Ih) and (Ii) are obtained in which OR is a hydroxyl group.

Class C—Trifunctional Phosphorous Compound
Organophosphoric Acid Esters of Formulas (Ij) and (Ij')

In this class of stabilized couplers, the preferred compounds are those in which G is hydrogen and p is 0.

Organophosphorated Compounds of of the Formulas (Ij) or (Ij') in which G is Hydrogen or a Sulfonic Group The phosphoric esters with the formulas (Ij) and (Ij') can be obtained by reaction of phosphoric anhydride with naphthalene-diol-2,3.

Preparation of Organophosphorated Compounds with Formulas (Ij) or Ij' in which G is a Sulfonate Group These compounds are obtained by the reaction of a compound with the formula (Ij) or (Ij') and having at least one sulfonic group with ammonia or an amine working either in aqueous solution or in solution in an inert organic solvent and under moderate conditions of temperature (in general, lower than 100°). It is advantageous to work at an ordinary temperature.

CARBONATE DERIVATIVES AND ALKYL ESTERS OF 2,3-DIHYDROXYNAPHTHALENE

The carbonate derivatives have the formula

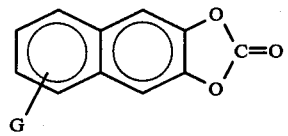

while the alkyl ether derivatives have the formula

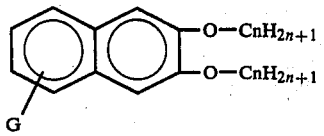

According to preferred embodiments, when G is a sulfonate of formula $[-SO_3^-, EH^+]$ E is ammoninia, tertiary aliphatic monoamine or tertiary aliphatic polyamine with the groups carried by the amine nitrogen being alkyl, hydroxyalkyl or alkylene with the alkyl portion having from 1 to 6 carbon atoms. Furthermore, when G is either the sulfonic group or sulfonate group, it is preferably at the C-6 position on the naphthyl ring.

The carbonate derivative can be prepared as follows:

To a solution under argon of 64.1 g of dihydroxy 2,3-naphthalene and 35.2 g of soda in 200 ml of water, 150 ml of dichloromethane and 6.4 g of triethylamine is added. 60 g of phosgene in solution in 150 ml of dichloroethane is then added dropwise over 30 minutes while maintaining the temperature at 50° C. It is stirred again for 30 minutes and then the mixture is poured off and the aqueous and organic layers are separated. The aqueous layer is extracted by using 50 ml of dichloroethane twice. The organic layers are joined together, dried over calcium chloride and distilled to eliminate the solvent. 74.4 g of crystals are recovered which are recrystallized twice in carbon tetrachloride. 54 g of crystals with a melting point of 150° C. are obtained. The synthesis yields 86% based on starting 2,3-dihydroxy naphthalene.

The ether derivatives are prepared as follows:

To prepare 2,3-diethyloxy naphthalene of the formula

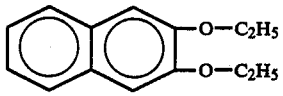

Two moles of ethyl chloride are mixed with one mole of dihydroxy 2,3 naphthalene in 500 ml of water and the mixture is heated to 70° C. Two moles of concentrated soda are then added, drop by drop, and heated for another 15 minutes. The precipitate is filtered, washed and dried. Its melting point is 99° C.

The dimethoxy 2,3 naphthalene with the following formula is prepared in the same way:

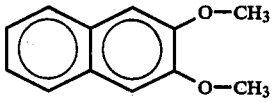

but replacing ethyl chloride by a stoichiometric amount of dimethyl sulfate.

In the same manner as with the phenylurethane stabilized couplers all of the stabilized phenolic coupler compounds can be used in association with basic decomposition catalysts to lower the decomposition temperature of the stabilized compound from the normal decomposition temperatures which generally range from about 150° C. to about 400° C. to decomposition temperatures as low as about 40° C., preferably 55° C. up to about 80° C. It is also advantageous to include the decomposition catalyst in a separate layer immediately adjacent to the layer containing the stabilized phenolic coupler compound. The types and amounts of the decomposition catalyst are the same as described above.

Any of the known chromogenic compounds which can directly react with a phenolic compound or which upon application of suitable actinic radiation or thermal energy form compounds which can react with phenolic compounds to form a colored reaction product can be used in the present invention. Compounds meeting these requirements are well known in the art. For example, spiropyran compounds and particularly the indolinobenzospiropyrans and benzothiazole spiropyrans, derivatives of triarylmethane, especially triphenylmethane compounds, ferric salts, silver salts and diazonium compounds can be mentioned as suitable chromogenic compounds.

The spiropyran compounds which can be used in the present invention include those which can react directly with the phenolic coupler compounds or which form a merocyanine compound upon exposure to actinic radiation, the merocyanine compound being reactive with phenolic coupler compounds to form colored reaction products. Examples of these compounds are disclosed, for example, in the aforementioned U.S. Pat. No. 3,451,338 to Baum, Swiss Patent Nos. 444,197 and 406,257 and U.S. Pat. No. 3,964,911 to Robillard, the disclosures of which are herein incorporated by reference.

The triarylmethane derivatives which are capable of reacting with phenolic couplers to give colored reaction products are also well known in the art and any of such compounds can be used in the chromogenic compositions and recording materials of the present invention.

Examples of the triarylmethane derivatives include the triphenylmethane paraamino leuco salts such as those derived from pararosaniline, malachite green and crystal violet. These salts are well known in the prior art, and their properties as well as methods of production are described in, for example, U.S. Pat. Nos. 2,366,179, 2,864,751 and 2,877,169, issued to Lyman Chalkley. Suitable triphenylmethane paraamino leuco salts include, for example, those having the following general formula:

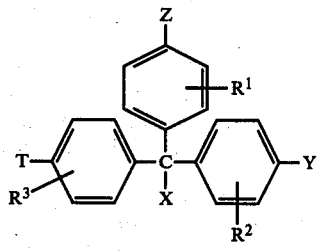

wherein X is halogen, CN or $HSO_3$; T, Y and Z which may be the same or different are hydrogen or substituted or unsubstituted amino group, at least one of T, Y or Z being an amino group; and $R^1$, $R^2$ and $R^3$ which may be the same or different are hydrogen, halogen or alkyl of 1 to 3 carbon atoms.

Preferred triphenyl methane derivatives include leuco dyes represented by the following general formulas:

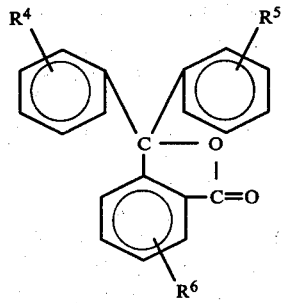

and

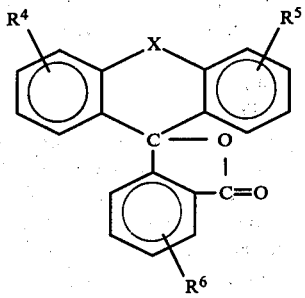

wherein $R^4$, $R^5$ and $R^6$ may be the same or different and are selected from the group consisting of hydrogen, halogen, hydroxyl (OH), amino ($NH_2$) and amino substituted by alkyl or alkoxy and X is O or S.

Examples of suitable chromogenic ferric salts which react with phenolic compounds to give colored reaction products include the ferric salts of organic acids, e.g. ferric stearate, ferric myristate, etc., such as those described, for example, in U.S. Pat. No. 2,663,654, the disclosure of which is incorporated herein by reference. As described in this patent, the colored reaction product obtained upon activation by application of heat to the ferric salt and phenol compound mixture is believed to be the result of the combination of the iron of the ferric salt and the phenolic portion of the phenol compound.

Examples of the chromogenic heat sensitive silver salts include silver salts of organic acids, for instance silver salts of fatty acids such as behenic acid, stearic acid and the like, benzoic acid, naphthenic acid, phthalic acid, acetic acid, citric acid, etc. Suitable silver salts that can be used in the present invention are described in greater detail, for example, in U.S. Pat. Nos. 3,457,075 and 3,094,417, the disclosures of which are incorporated herein by reference. These silver salts generally form brown, blue or black colored reaction products with the phenol coupler compounds. These silver salts are not photosensitive but will react upon application of heat. Therefore, the silver salts are particularly useful in thermographic compositions and recording materials for use in thermographic recording processes operating with infrared printing apparatus or in photothermographic reproduction processes using catalytic amounts of photosensitive silver salts as catalysts.

Any of the diazonium compounds utilized in diazotype processes, including dry, wet or semi-wet development diazo-type processes wherein the diazonium compound is caused to react with a phenolic coupler compound can be used in the present invention. For instance, the diazonium compounds disclosed in the aforementioned patent to Nihyakumen as well as the diazonium compounds described in the aforementioned patent to Robillard can be used as the chromogenic compounds of the present invention.

The ratio by weight between the chromogenic compound and the phenylurethane is not particularly critical but generally is between from about 0.01 to 1 to about 10 to 1 and preferably is between about 0.05 to 1 to about 3 to 1, most preferably from 0.1 to 1 to 1 to 1. This weight ratio depends on the nature of the chromogenic compound utilized.

Although not required, it is generally preferable to add a binder to the composition since this aids in the formation of the sensitive layer. Any of the conventional binders such as polyvinyl alcohols, polyvinyl esters, acrylic ester, homo or copolymers of polyvinyl chloride or any other binder well known in the art can be used.

In actual practice in utilizing the chromogenic compositions as the source of the active color forming components of the sensitive layer of a recording or reproduction material, the chromogenic compound and phenylurethane can be present in separate adjacent layers or in a single layer. A single layer is preferred, particularly where the decomposition of the phenylurethane is caused by the application of a gaseous or liquid fluid. When development of the colored image is accomplished by the applieation of thermal energy utilizing a heated stylus, hot type, etc., separate layers of the chromogenic compound and phenylurethane, each dispersed in a suitable polymeric binder, can be used without disadvantage.

The polymeric binders should preferably have softening or melting points somewhat below the decomposition temperatures of the stabilized phenolic coupler compound so as to facilitate the contact between the unblocked phenolic coupler compound produced by the decomposition and the chromogenic compound. Since the decomposition temperature of the phenylurethane is generally between 80° and 200° C., most of the conventional binders will be suitable. For the carbonate derivatives of the phenolic coupler compounds, such as the preferred 2,3 dihydroxynapthalene carbonate the decomposition temperature is about 350° C., although by incorporating a small amount of decomposition catalyst the decomposition temperature can be lowered to only 80° C. or even down to 55° C. without adversely affecting the storage stability of the composition and recording and reproduction materials.

The alkyl ether derivatives have decomposition temperatures on the order of about 200° C. The decomposition temperature of the silyl ether derivatives is about 250° C. in the dry state and only about 150° C. under humid or wet conditions. The phosphoric acid ester derivatives generally have decomposition temperatures on the order of about 160° C. For all of these stabilized phenolic coupler compounds, decomposition temperatures down to as low as 80° C. or even 55° C. to 40° C. can be achieved with small amounts of the basic decomposition catalysts.

The sensitive layer of the recording or reproduction material, including the chromogenic compound and the stabilized phenolic coupler compound as the essential color forming reactants, and any optional ingredients, such as binders, hydroxyl-group containing reactant, decomposition catalysts and other conventionally used adjuvants such as tonality modifiers, such as phthalimide, succimide, phthalazinone, etc. stabilizers, humectants, fillers and the like, is formed by coating a suitable support with one or more layers of the above ingredients. The ingredients are applied as uniform solutions or dispersions according to the conventional and well known techniques. Any of the conventional supports, such as paper, plastic, metals, foils, etc. can be used.

The thus produced recording or reproduction material which includes the layer of the sensitive chromogenic composition on a support can be used to record information according to a dry thermal technique simply by applying sufficient thermal energy to the sensitive layer to raise the temperature of the stable phenolic coupler compound derivatives above its decomposition temperature in those regions where the thermal energy was applied. The resulting phenolic coupler compound will then immediately react (couple) with the chromogenic compound to produce the colored information according to the desired pattern corresponding to the input of thermal energy.

The thermal energy can be applied by using a heated stylus, heated type, etc. according to conventional and well known techniques utilizing conventional and well known apparatus commonly used in various scientific and medical as well as non-technical communications, applications.

The suitable temperature of the heating head and the time of application will vary depending, of course, on the decomposition temperature of the stabilized phenolic coupler compound, the binder, etc. but can be readily determined by routine experimentation. Generally, temperatures between about 80° and 200° C. are suitable, and these temperatures can be lowered by utilizing in the sensitive layer one or more of the decomposition catalysts mentioned above.

The present invention also provides a process for reproduction of an original transparency containing transparent non-image areas and opaque or translucent image areas by a combination of light and thermal exposure of the reproduction element. According to this mode of operation which is particularly suitable for the diazonium salt chromogenic compounds, but also for the spiropyran compounds and triphenylmethane derivatives which are sensitive to actinic radiation, the reproduction material is exposed, through the original, to actinic radiation of suitable wavelength depending on the absorption spectra of the particular chromogenic compound, and then the recording material is heated by any suitable means to the decomposition temperature of the stabilized phenolic coupler compound whereby the resulting phenolic coupler will selectively react with the chromogenic compound only in the zones corresponding to the image areas of the original or only in the zones corresponding to the non-image areas of the original depending on the type of the chromogenic compounds. Thus, using the diazonium salts positive reproductions of the original can be obtained; negative reproductions can be obtained with spiropyran compounds which are converted by the actinic radiation impinging on the exposed zones to merocyanine compounds which form color complexes with the phenolic couplers.

Thermal reproductions can also be made according to the infrared thermocopy process, such as the Thermofax process. Any of the chromogenic compounds can be suitably used in this embodiment.

The details of the various thermal reproduction and recording processes are well known to the ordinary practitioner and suitable conditions for any particular combination of chromogenic compound and stabilized coupler compound can readily be determined.

The recording or reproduction materials of the present invention can also be developed by contacting the sensitive layer containing the stabilized phenolic coupler compound with a developer fluid which can be gaseous or liquid and which is capable of decomposing the blocked phenolic compound into the corresponding phenol and blocking agent, e.g. isocyanate. However, because of the present technical impracticality of utilizing a gaseous developing fluid in a recording mode, the use of the gaseous developing fluid is limited to reproduction processes wherein the sensitive layer is first exposed to suitable actinic radiation and then the gaseous developer can be applied over the entirety of the sensitive layer to unblock the phenolic coupler and permit the coupling reaction to take place selectively in only unexposed image areas or in only exposed non-image areas as described above for the thermal reproduction process.

However, when the fluid developer is a liquid, either original recordings of information or reproductions of transparencies can be made. In the recording process mode the liquid material is used with a conventional point or "inker" stylet, in which the ink is replaced by the liquid developer. In the reproduction process mode the liquid developer is applied to the sensitive layer after imagewise exposure to actinic radiation. The development can, for example, take place simply by immersing the exposed reproduction material in a bath of the developer liquid. This wet type of reproduction process can be performed utilizing any suitable apparatus such as conventionally used in diazo-type printing processes.

It is also advantageous when using an "inker" stylet to accelerate the coupling reaction and also to dry the reproduction material by heating the reproduction material to a temperature between about 40° C., preferably 50° C., and the decomposition temperature of the phenylurethane.

The developer fluids are generally the same as the decomposition catalyst described above and include, for example, ammonia (gas or liquid); bases, such as soda, potash, etc.; aliphatic amines and preferably aliphatic tertiary amines of the general formula

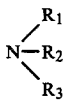

wherein $R_1$, $R_2$ and $R_3$ can be the same or different and each alkyl or alkylene of from 1 to 10 carbon atoms; aliphatic tertiary polyamines such as, for example, hexamethylene tetramine, triethylenediamine, etc.; hydroxyl amines (or amino alcohols) such as mono-, di- or triethanolamine, 2-amino-1-butanol, tri(hydroxymethyl-)aminoethane, etc.; organic or inorganic ammonium salts such as carbonates, hydrocarbonates, formates, oxalates, benzoates, etc.; and morpholine derivatives such as morpholine, N-methyl-morpholine, 2,6-dimethylmorpholine, N-aminoethyl morpholine, etc.

A particularly important application of the invention is diazo-type reproductions, in all forms, whether the development be thermal, by the semi-wet method or by the gaseous method with ammonia. The invention makes considerable improvements in relation to conventional diazo-type materials since the phenolic coupler is blocked and there is no risk of precoupling and the material can be stored for an indeterminate period without there being the slightest appearance of phenol in the sensitive layer. It is also possible to limit considerably the amount of stabilization adjuvants generally used in these layers. In the case of diazotype, it is not necessary to use a binder to associate the diazonium compound and the stabilized phenolic coupler compound. The proportions by weight between the diazonium compound and the stabilized coupler can vary between about 0.3 to 1 to about 3 to 1. In all cases, the fluids used for development can be pure or in solution.

The invention will be better understood by the following examples, which are for purposes of illustration only and are not limitative of the scope of the present invention. In all the examples, the identification of the various compounds has been confirmed by microanalysis, infrared analysis, spectral analysis by nuclear magnetic resonance and mass spectrography.

EXAMPLE 1

8 grams of 2,3-dihydroxynaphthalene, 100 grams of dried methylethylketone (MEK) and some drops of triethylamine are placed in a three-necked flask provided with an agitator, an ascending condenser and a dropping funnel.

12 grams of phenyl isocyanate are added, dropwise, with a dropping funnel. The reaction mixture is heated slightly, a white precipitate forms which is filtered, washed with methyl ethyl ketone and dried. This precipitate is naphthyl diphenyl urethane.

On a base paper, coated with a layer that is a barrier to solvents, a layer of the following composition is deposited:

1 gram of naphthyl diphenyl urethane, 10 grams of 10% solution in tetrahydrofuran of the resin AXRH (vinyl copolymer of the Societe Rhone Poulenc).

The deposited layer is dried at 50° C.

The following composition is separatedly prepared in a mill:

0.4 gram of 1'-isopropyl-3',3'dimethyl-6-nitro-8-methoxy spiro (2H-1 benzopyran-2,2'-indoline)

10 grams of 10% aqueous solution of Rhodoviol 4/125 P (polyvinyl alcohol of the Societe Rhone Poulenc).

This composition is deposited with a Meyer rule above the preceding layer and dried at 70° C.

The sensitive layer of the thus prepared recording and reproduction material is heated with a heating head brought to 150° C. A blackish blue line on a light background is formed.

EXAMPLE 2

The operation for preparing a phenylurethane compound in Example 1 is followed with the 2,3-dihydroxynaphthalene replaced with the same amount of 4,4'-isopropylidene diphenol (Bisphenol A) and the phenyl isocyanate replaced with a stoichiometric equivalent amount of 2,4-tolylene diisocyanate (TDI).

There are dispersed in a mill:

20 grams of bishenol A blocked to the TDI 100 grams of Rhodoviol 4/20 (polyvinyl alcohol of the Societe Rhone Poulenc) at 10% in water 2 grams of crystal violet lactone 3 grams of zinc oxide 10 grams of ethylene glycol.

A layer of this composition is deposited on a support at a rate of 5 gr per $m^2$ by means of a Meyer rule and dried. By contacting the sensitive layer with a thermal head brought to 150° C. a blue line on a light background is formed.

EXAMPLE 3

Phenylurethane is prepared as in the preceding examples by adding 3 molecules of phenyl isocyanate to a molecule of pyrogallol. The blocked pyrogallol which precipitates is collected and dried.

The following ingredients are energetically dispersed in the ball mill:

5 grams of ferric stearate 3 grams of blocked pyrogallol 20 grams of Rhovinal B 10 (polyvinyl butyral of the Societe Rhone Poulenc) at 10% in isopropanol 10 grams of 1,4-butane diol. After coating on paper, a thermal head brought to 120° C. causes the formation of deep brown lines on a white background.

EXAMPLE 4

The following composition is prepared:

| | |
|---|---|
| naphthyl diphenylurethane | 2.5 grams |
| 4-diazo 2,5-dibutoxy phenyl morpholine chlorozincate | 3 grams |
| citric acid | 1.5 grams |
| water | 175 cc |
| methyl ethyl ketone | 175 cc |

This solution is deposited on paper at a rate of 2 grams per $m^2$ and dried.

By exposure to ultraviolet rays under a transparent original, then heating at 140° C. for 20 seconds there is obtained a blue positive image of the original.

EXAMPLE 5

The following composition is prepared:

| | |
|---|---|
| naphthyl diphenylurethane | 10 grams |
| 4-diazo 2,5-dibutoxy phenyl morpholine | 20 grams |
| citric acid | 10 grams |
| ethylene glycol | 10 ml |
| methylethylketone | 1 l |

This composition is then deposited on a paper support at a rate of 20 cc/$cm^2$, then dried. Four such reproduction materials are prepared.

After exposure under a transparent original, each of the four samples are developed with one of the following solutions, with a roller developer of the "semi-wet" machine type:

aqueous solution of soda at 10% by weight aqueous solution of ethanol amine at 20% aqueous solution of triethanol amine at 80% aqueous solution of triethylene diamine at 5%.

In each of these four cases a blue image with excellent quality is obtained.

EXAMPLE 6

A material such as that obtained in example 5 is used. After exposure under a positive original transparency and development by contact with ammonia vapors of a diazo machine, a copy with excellent quality is also obtained.

EXAMPLE 7

The following composition is prepared:

| | |
|---|---|
| p-diethylamino benzene diazonium borofluoride | 10 g |
| pyrogallol blocked with toluene diisocyanate | 10 g |
| citric acid | 5 g |
| ethanol | 500 ml |
| thiourea | 5 g |

After coating on a paper support, then exposure through a positive original transparency, the copy is developed with one of the following liquids:

normal ammonia solution (1 N)

pure piperidine pure N-methyl morpholine a brown image with excellent quality is obtained at ambient temperature. To dry the material, the latter can be heated with the quality of the copy being improved.

EXAMPLE 8

The composition of Example 7 is used; it is coated in the same way on a paper support, then exposed through a positive. After development in a 20% aqueous solution of ammonium hydrogen carbonate, the support is dried at a temperature greater than or equal to 50° C. and a copy with excellent quality is obtained.

EXAMPLE 9

To the composition of Example 1, is added 0.05 g of dilauryl dibutyl tin. After coating on a paper support, there is obtained the same colored line but at a temperature of only 120° C.

EXAMPLE 10

To the composition of Example 2, is added 1 gram of lead octoate. A colored line of the same intensity as in Example 2 is obtained at a temperature of only 140° C.

EXAMPLE 11

On the material of Example 3 is coated a superlayer made up of:

| | |
|---|---|
| Rhodoviol 4/125 (polyvinyl alcohol of Societe Rhone Poulenc) at 10% in water | 5 grams |
| triethylene diamine | 0.5 grams |

There is obtained a dark brown colored line of the same intensity as in Example 3, with a heating head brought to a temperature of only 100° C.

EXAMPLE 12

On the material of Example 4, is deposited a superlayer made up of a 5% solution by weight of ammonium carbonate in polyvinyl alcohol.

After exposure under a translucid original, the material is developed at a temperature of 102° C. and a blue line is obtained.

EXAMPLE 13

The material obtained in Example 4 is used. There is deposited on its back at a rate of 10 g/m$^2$, the following dispersion:

| | |
|---|---|
| ground borax | 5 grams |
| ground ammonium fluorosilicate | 15 grams |
| Rhodopas H (polyvinyl acetate of the Society Rhone Poulenc) | 5 grams |
| toluene | 30 ml |

Ultraviolet exposure is performed through a translucid original, then heating at 110° C. for about 10 seconds. A positive blue image of the original is obtained.

EXAMPLE 14

The following materials are uniformly dispersed in a Dangoummeau grinder:

| | |
|---|---|
| 10% ethyl cellulose in methyl ethyl ketone | 20 g |
| Silver behenate | 2 g |
| Reaction product of 4-methoxy-1-nphthol and phenyl isocyanate | 0.3 g |

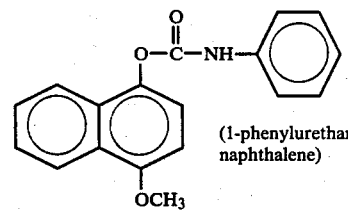

(1-phenylurethane-4-methoxy-naphthalene)

The resulting composition is applied with a Meyer bar on a paper substrate and dried. By means of a hot point recorder, a balckish blue trace on a cream colored background is obtained.

It is also possible to obtain a blackish blue color positive reproduction with an infrared copying machine such as the "Thermofax" type.

EXAMPLE 15

Following the procedure of Example 14 but with the following composition uniformly mixed in a Dangoummeau grinder:

| | |
|---|---|
| 10% Rhodopas H (polyvinylacetate of Rhone Poulenc Company) in ethylacetate | 20 g |
| Silver stearate | 1.4 g |
| Reaction product of phloroglucine and phenyl isocyanate | 0.6 g |
| Dibutyl tin dilauryl | 0.002 g |

a dark chestnut trace on a blue background is obtained.

The above examples have been given only by way of nonlimiting examples, to illustrate the invention whose various applications and modifications can be understood by a person or ordinary skill in the art: the invention is actually applicable to all recording and reproducing processes using phenolic coupler agents, when it is desired to produce the latter in situ, by unblocking of phenylurethane present in the sensitive layer. The following examples illustrate the invention with respect to 2,3-dihydroxynaphthalene which has been stabilized by blocking the hydroxyl groups with various blocking agents.

EXAMPLE 16

Naphthalene dioxo-2,3 dimethylsilane of the following formula:

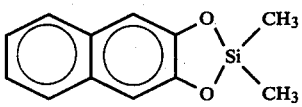

in equilibrium with its dimer having the following formula:

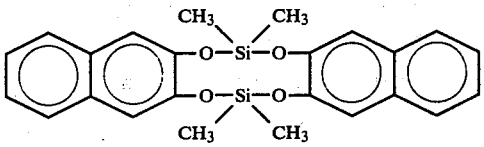

is prepared as follows:

To a solution of 64.1 g of dihydroxy-2,3 naphthalene in 600 ml of toluene is added 1 g of triethylamine and 56.8 g of dichlorodimethylsilane is added dropwise to reflux (110°) in two hours. Then the heating is maintained for two hours until the end of the separation of hydrochloric acid. The hydrochlorate of triethylamine is cooled and filtered and the solvent is eliminated by distillation, with 80 g of a white precipitate corresponding to the dimer (melting point, 190°) being obtained. By distillation of the dimer, one obtains the monomer, which is in liquid form at ordinary temperature. It is changed very slowly into the dimer.

Then the following recording material is produced:

On a paper support, an initial layer from an aqueous dispersion of the following composition (3 g per square meter) is applied:

| | |
|---|---|
| Crystal violet lactone | 0.5 g |
| Carboxylated styrene butadiene (Dow latex 241 of the Dow Chemical Co. | 30 g |

After drying, a second layer (2 g/m$^2$) is applied of the following mixture:

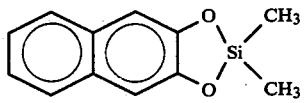

3 g

The recording of information is carried out on this material using a point heated to about 120° C. A blue trace against a white background is obtained.

EXAMPLE 17

Synthesis of naphthalene dioxo-2,3 diphenylsilane having the following formula is carried out:

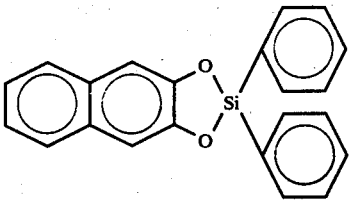

in equilibrium with its dimer:

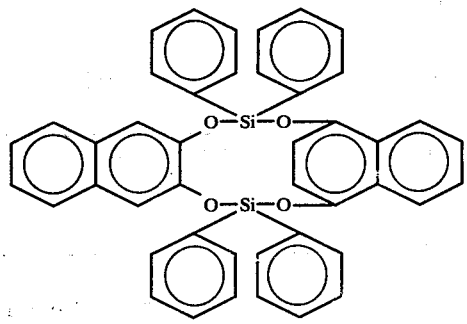

One introduces 64.1 g of dihydroxy-2,3-naphthalene, 500 ml of toluene and 1 ml of triethylamine into a balloon flask, heats to reflux and then adds dropwise 111.4 g of dichlorodiphenylsilane over two hours. The mixture is kept at reflux for six hours to ensure the end of the separation of hydrochloric acid. The precipitate of hydrochlorate of triethylamine is cooled and filtered, the solvent is distilled and the precipitate is rinsed in acetonitrile (50 g, twice). After recrystallization in ethyl cyanide, one obtains 135 g of a compound corresponding to the dimer (melting: 169°–170°). By distillation, one obtains the liquid monomer at ambient temperature which changes slowly into the dimer.

The following products are dispersed in the Dangoummeau crusher:

| | |
|---|---|
| 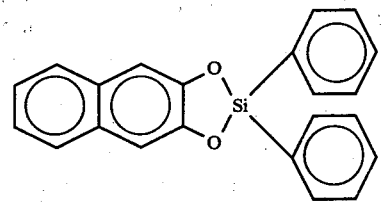 | 3 g |
| 1'-isopropryl, 3'3'-dimethyl, 6-nitro, 8-methoxy spiro (2H—1 benzopyrane-2,2' indoline) | 1 g |
| Polyvinyl alcohol (Rhodoviol 4/125 of the Societe Rhone-Poulenc, at 10% by weight in water) | 50 g |

This sensitive layer is coated on a paper support in the ratio of about 6 g per square meter. A thermal recording is carried out as in the preceding example. The trace obtained is blue-black in color against a white background.

EXAMPLE 18

The synthesis of the compound with the following formula is carried out:

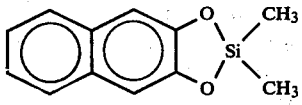

in accordance with the procedure described in Example 1.

Then the following homogeneous mixture is prepared:

| | |
|---|---|
| 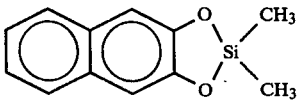 | 5 g |
| Acetate of polyvinyl (Rhodopas H 45 AE of the Societe Rhone-Poulenc) | 50 g |
| Silver behenate | 5 g |
| Ferric stearate | 10 g |
| Hexamethylene tetramine | 0.05 g |
| Ethyl acetate | 100 cubic centimeters |

After coating a paper support with this mixture in the ratio of about 4 g per square meter, a thermal recording is carried out as in Example 1. The trace obtained is maroon against a light background.

EXAMPLE 19

The synthesis of the trimethylsilylated diether of 2,3 di-hydroxy-naphthalene with the following formula is carried out:

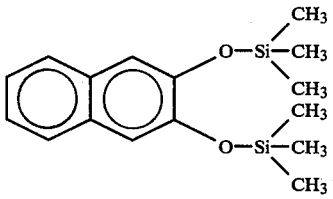

Into a suspension of 64.1 g of dihydroxy-2,3 naphthalene in 150 ml of dichloromethane, 200 ml of bistrimethylsilylacetamide is added dropwise over one hour. It is brought to a boil for six hours, and then the reaction mixture is distilled. 118 g of silylated diether (boiling point, 124°) is obtained.

Then the following composition is prepared:

| | |
|---|---|
| Diether trimethylsilylate of 2,3 dihydroxy naphthalene | 2 g |
| Citric acid | 1 g |
| Thiourea | 2 g |
| 4-diazo-2,5-dibutoxy phenyl morpholine borofluoride | 3 g |
| Methyl ethyl ketone | 200 g |

This composition is used to coat a paper support in the ratio of 20 cubic centimeters per square meter. After drying, the paper is exposed to UV radiation through an original transparency with the image being developed under the conditions summarized in the following table.

| Example Number | Development Procedure | Result Obtained |
|---|---|---|
| i | Heating to 150° C. for 10 seconds | Light blue image |
| ii | Passage into an ammonia printing machine at about 60° C. | Navy blue image |
| iii | Development by using the following solution: triethylene diamine, 7.5 g; water, 100 g. | Light blue image |
| iv | Same development conditions as in Example iii, then heating to 80° C. | Dark blue image |
| v | Development by using the following solution: thiourea, 1 g; metaborate of soda, 1 g; metaborate of potassium, 5 g; water, 1 liter | |
| vi | Development identical with v; then heating to 80° for 4 seconds | Blue image |
| vii | Development by using the following solution: monoethanolamine, 10 ml; water, 90 ml | Navy blue image |
| viii | Development in a thermal machine at 100° for 10 seconds; the back of the paper was impregnated with a layer consisting of a mixture of sulfate of ammonium (⅔) and sodium bicarbonate (⅓) (as described in French Patent No. 1,418,156) | Navy blue image |

EXAMPLE 20

The following solution is prepared:

| | |
|---|---|
| 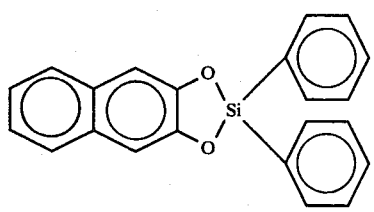 | 13 g |
| (prepared as in Example 17) | |
| Citric acid | 5 g |
| Thiourea | 10 g |
| Methylethyl ketone | 1 liter |
| Paradimethyl aminobenzene diazonium borofluoride | 12 g |

This solution is applied in the ratio of 15 cubic centimeters per square meter on a polyester support coated with a layer of a varnish with a cellulose acetate of base. The sensitive layer on the support is exposed to UV through an original and then the same methods of development are used as in Examples 19i through 19 viii (in the case, the layer on the back in Example 19 viii is applied as a topcoat on the cellulose acetate.

EXAMPLE 21

The naphthalene-dioxy-2,3 diphenylsilane in Example 20 is replaced by a stoichiometrically equivalent quantity of naphthalene-dioxy-2,3 dimethylsilane prepared in accordance with Example 18, with the following formula:

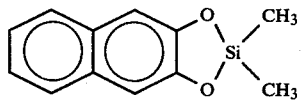

The same results are obtained as in Example 20 (the same coloration for the same methods of development).

EXAMPLE 22

The synthesis of naphthalene-dioxy-2,3 bis(dimethylsilyl) 1,2 ethane having the following formula is carried out:

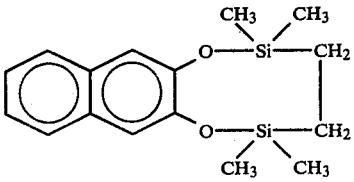

64.1 g of dihydroxy-2,3 naphthalene, 500 ml of toluene and 2 ml of triethylamine are introduced into a balloon flask, which is heated to reflux and 94.7 g of bis(chlorodimethylsilane) ethane in solution in 50 ml of toluene is added dropwise over two hours. The reaction mixture is kept at reflux for three hours to ensure the complete separation of hydrochloric acid. The hydrochlorate of triethylamine is cooled and filtered, the toluene is distilled and a fraction (boiling point, 0.9 140°) of 93.5 g of naphthalene-dioxy-2,3 bis(dimethylsilane)-1,2 ethane is obtained by vacuum distillation.

Then the following solution is prepared:

| | |
|---|---|
| Naphthalene-dioxy-2,3 bis(dimethyl silane) 1,2 ethane | 11.5 g |
| Citric acid | 5 g |
| Thiourea | 10 g |
| Methyl ethyl ketone | 1 liter |
| Paradiethyl amino benzene diazonium borofluoride | 12 g |

This solution is coated on a paper support in the ratio of 15 cubic centimeters to a square meter. After exposure through an original, the image is developed in accordance with the procedures described in Examples 19i through 19viii, respectively. The same respective colors are obtained as in Example 20. However, it was determined that the development of the image with ammonia (as in Example 19ii) is much quicker than in the preceding examples. The sensitivity of such diazotype material is approximately the same as that of the corresponding material in which the phenolic coupler compound has not been blocked.

EXAMPLES 23 THROUGH 25

The synthesis of a stabilized organo phosphoric and acid coupler compound having the following formula is carried out:

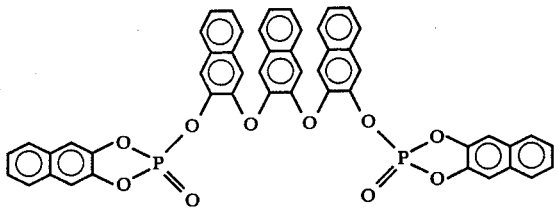

64.1 g of dihydroxy-2,3 naphthalene in 500 ml of benzene is mixed with 81 g of triethylamine. 68 g of oxychloride of phosphorus $POCl_3$ is added dropwise into the boiling solution in two hours and reflux conditions are maintained for one hour until the end of the separation of hydrochloric acid. The reaction mixture is cooled with ice, and then 20 ml of water are added and it is filtered.

The precipitate is washed four times with 100 ml of chilled water and then three times with 100 ml of acetonitrile. 74 g of white solid, which is recrystallized in DMF (dimethylformamide), corresponding to the expected formula is obtained.

Then the following solution is prepared:

| | |
|---|---|
| (The above product containing phosphorus) | 16 g |
| Dimethyl formamide | 1 liter |
| citric acid | 5 g |
| thiourea | 10 g |
| 4-diazo 2,5-diethoxyphenylmorpholine borofluoride | 20 g |

A paper support is coated with this solution in the ratio of 15 cubic centimeters per square meter.

After exposure through an original, the material is developed by various procedures. The results are listed in the following table:

| Example Number | Development Procedure | Color obtained |
|---|---|---|
| i | Ammonia (g) | Green |
| ii | Solution of triethanolamine | Pale blue |
| iii | Development at 120° by putting into contact for 10 seconds with a piece of paper coated with a solution of ammonium (⅔) of sulfate and sodium bicarbonate (⅓) by weight. | Green |

EXAMPLE 26

The synthesis of the hydrogenophosphate of 2,3 hydroxynaphthalene having the following formula is carried out:

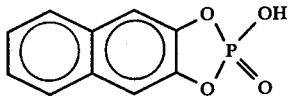

80.1 g of dihydroxy-2,3 naphthalene, 2 ml of triethylamine and 250 ml of oxychloride of phosphorus $POCl_3$, freshly distilled are loaded into a balloon flask. The mixture is heated to reflux slowly, which assures dissolution, and it is then kept at reflux for four hours in order to ensure the complete separation of the hydrochloric acid.

The mixture is cooled. The hydrochlorate of triethylamine is filtered and distilled. A while solid corresponding to the following formula is obtained:

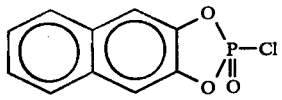

This compound is cooled to 0° and then hydrolyzed very slowly at that temperature with 220 ml of water.

The aqueous stage is extracted with ethyl acetate (100 cc four times). The solvent is distilled and the expected compound (it melts and decomposes at 160°) is obtained.

The following solution is smeared on a paper support in the ratio of 3 g per square meter:

| | |
|---|---|
| Polyethylene in aqueous dispersion (EPOTAL 181 D of the BASF company) (m.p.= 80–100°) | 25 g |

-continued

| | |
|---|---|
| Triethylene diamine | 2.5 g |
| Water | 25 g |

After drying, a coating is applied, in the ratio of 15 cubic centimeters per square meter, of the solution that is constituted as follows:

| | |
|---|---|
| 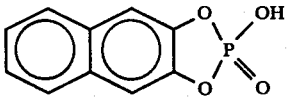 | 1 g |
| Citric acid | 0.6 g |
| Thiourea | 1.3 g |
| 4-diazo-2,5 diethoxy phenyl morpholine chlorozincate | 2.5 g |
| Water | 60 g |
| Alcohol | 60 g |

After exposure through an original, the diazotype material is developed in a thermal developing machine (120° C. for 8 seconds). The image obtained is blue-violet in color and no disagreeable odor is perceived while developing is going on. The same material is also developed in a "dry" and a "semi-wet" printing machine. The same results are obtained.

It should be noted that the separate layer containing trimethylenediamine as a decomposition catalyst makes it possible to catalyze the unblocking of the coupler and, at the same time, to ensure an alkaline environment favorable to the reaction.

EXAMPLE 27

A paper support is coated, in the ratio of 5 g per square meter, with the following sublayer:

| | |
|---|---|
| Rhodopas S 051 (emulsion of polystyrene from the Rhone-Poulenc company) | 70 g |
| Diofan 207 D (polyvinylidene chloride from the BASF company) | 30 g |
| Hexamethylenetetramine | 5 g |

This sublayer is then covered with the same top layer as in Example 18. Under the same conditions, the same results are obtained.

EXAMPLE 28

A paper support is coated, in the ratio of 5 g per square meter, with the following sublayer:

| | |
|---|---|
| Dow Latex 241 (carboxylated styrene-butadiene resin from the Dow Chemical company) | 12.5 g |
| Neocryl A 291 (acrylic styrenated resin from Polyvinyl Chemie) | 12.5 g |
| Water | 25 g |
| 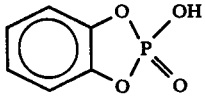 | 0.6 g |

Then a coating of the following top layer is applied over the sublayer (20 cubic centimeters per square meter):

| | |
|---|---|
| Water | 50 g |

-continued

| | |
|---|---|
| Citric acid | 0.5 g |
| Thiourea | 1 g |
| Paradiethylaminobenzene diazonium chlorozinate | 0.75 g |
| Dabco WT (compound with a triethylene-diamine base from the Air Products and Chemicals Inc. company) | 1 g |

After exposure through an original, the material is developed at 100° C. for 8 seconds. A dark blue-violet coloration is obtained.

EXAMPLE 29

One dispenses, in a ball-mill, the following composition:

| | |
|---|---|
| Bicarbonate of sodium | 50 g |
| Sulfate of ammonium | 200 g |
| Polyvinyl acetate (Rhodopas H from the Rhone-Poulenc company) | 35 g |
| Toluene | 250 g |

This dispersion is applied to the back of a paper support in the ratio of 10 g per square meter.

Then the following layer is coated on the other side of the support:

| | |
|---|---|
| 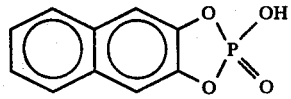 | 1 g |
| Citric acid | 0.6 g |
| Thiourea | 1.3 g |
| 4 diazo 2,5-diethoxy phenylmorpholine chlorozincate | 2.5 g |
| Water | 60 g |
| Alcohol | 60 g |

After exposure, the development is accomplished in a printing machine by means of heat at 120° C. for 8 seconds. The appearance of a blue-violet image is observed.

EXAMPLE 30

The following composition is formed:

| | |
|---|---|
| 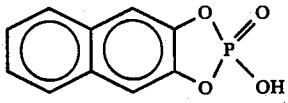 | 7 g |
| Crystal violet lactone | 0.5 g |
| Carboxylated styrene-butadiene resin in emulsion (Dow Latex 24) | 65 g |

This mixture is homogenized and then applied as a coating to a paper support in the ratio of 3 g per square meter.

In this way, a paper for thermal recording developable at 130° C. is obtained which has very good stability in storage.

EXAMPLE 31

The following composition is mixed in a Dangoumeau mixer:

| | |
|---|---|
| 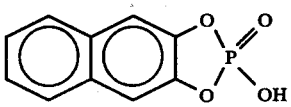 | 10 g |
| 1',3',3'-trimethyl, 6-nitro, 8-methoxy spiro (2H—1 benzopyran-2,2'-indoline) | 5 g |
| Polyvinyl alcohol (Rhodoviol 4/20 from the Rhone-Poulenc company) 10% by weight in water. | 120 g |

This composition is applied as a coating to a paper support in the ratio of 6 g per square meter. By recording with a point heated to 140° C., a trace of navy-blue color against a light background is obtained.

EXAMPLE 32

The following mixture is formed:

| | |
|---|---|
| Behenate of silver | 5 g |
| 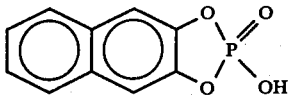 | 8 g |
| Triethylene diamine | 0.3 g |
| 15% by weight of polystyrene in methylethyl ketone | 50 g |
| Methylethyl ketone | 30 g |

This solution is applied as a coating to a paper support in the ratio of 5 g per square meter. By recording with a point heated to 140° C., a trace of dark maroon color is obtained.

EXAMPLES 33 AND 34

Ammonium salt is prepared from the hydrogenophosphate of 2,3 naphthyl having the following formula:

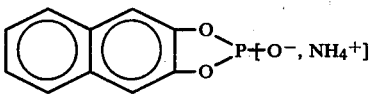

Onto 2.22 g of hydrogenophosphate of 2,3 naphthyl (prepared as in Example 26) in solution in 10 ml of water, 1 ml of ammonia (d=0.92) diluted in 10 ml of water are poured slowly, while cooling to 0°. Ammonium salt is precipitated. It is filtered, washed in water and dried. In this way, 2.2 g of a white solid corresponding to the expected formula are obtained.

The 2,3 naphthylphosphate of triethylene diamine having the following formula is also prepared:

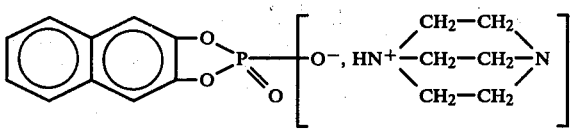

Onto 1.34 g of triethylene diamine in solution in 15 ml of isopropyl alcohol, a solution of 2.22 g of hydrogenophosphate of 2,3 dihydroxynaphthalene in 15 ml of isopropyl alcohol is poured slowly, while cooling to 0°. Amine salt is precipitated. It is filtered, washed in cold isopropyl alcohol and dried. In this way, 3.3 g of white solid corresponding to the expected formula are obtained.

Then the following solution is made:

| | |
|---|---|
| 2,3 naphthylphosphate of triethylene diamine | 12 g |
| Water | 1 liter |

This solution is applied to a paper support in the ratio of 20 cubic centimeters per square meter.

Then the following top layer is applied in the ratio of 20 cubic centimeters per square meter:

| | |
|---|---|
| Citric acid | 5 g |
| Thiourea | 10 g |
| Paradiethylamino benzene diazonium chlorozincate | 15 g |
| Ammonium acetate | 10 g |
| Water | 1 liter |

After exposure through an original, the material is developed in a thermal machine at 120° C. for 10 seconds. A blue-violet copy is obtained.

The same result is obtained by developing in the presence of ammonia.

The same solution as above is made, replacing the 2,3-naphthylphosphate of triethylene diamine by ammonium salt from the hydrogenophosphate of 2,3 dihydroxynaphthalene in the first layer and replacing the ammonium acetate in the second layer by urea. The respective weights of the new constituents remain the same as in the preceding compounds. The same results are obtained by operating under the same conditions as before.

EXAMPLE 35

The following composition is prepared

| | |
|---|---|
| Carbonate of dihydroxy 2,3 naphthalene | 2 g |
| Citric acid | 1 g |
| Thiourea | 2 g |
| 4 diazo 2,5 dibutoxy phenyl morpholine borofluoride | 3 g |
| Methyl ethyl ketone | 200 g |

This composition is coated on paper in the ratio of 20 cubic meters to the square meter. The paper is dried and then exposed to UV through an original transparency. The following results are obtained, depending upon the method of development.

| Example Number | Developer Used | Color of the Image |
|---|---|---|
| i | Heating to 150° C. for 10 seconds | Light blue |
| ii | Passage into an ammonia development machine at a temperature of about 60° C. | Navy blue |
| iii | Aqueous solution of triethylene diamine at 75 g/l | Light blue |
| iv | Solution as in iii, the heating to 80° C. for about 5 sec. | Dark blue |
| v | Aqueous solution containing 1 g/l of thiourea, 1 g/l of metaborate of soda, 5 g/l of metaborate of potassium | Light blue |
| vi | Solution as in v, then heating to 80° C. for 4 sec. | Blue |
| vii | Aqueous solution with 10% of | Navy blue |

-continued

| Example Number | Developer Used | Color of the Image |
|---|---|---|
| viii | volume of monoethanol amine Heating to 110° C. for 10 sec., with the paper support being impregnated on the back with a mixture of ⅔ ammonium sulfate and ⅓ of sodium bicarbonate by weight | Navy blue |

It should be noted that the composition used in this example includes practically no stabilizer by comparison with the traditional diazo compositions. The purpose of the only adjuvants used is to place the layer at acid pH, since the cyclical carbonate is very stable and there is no danger of precoupling.

EXAMPLE 36

The following composition is mixed:

| | |
|---|---|
| Carbonate of dihydroxy 2,3 naphthalene | 2.5 g |
| Ferric stearate | 4.5 g |
| 10% by weight of polystyrene in methyl ethyl ketone | 110 g |

This composition is coated on a paper support in the ratio of 4.5 g per square meter and dried.

By using a stylet heated to 140° C., one obtains a midnight blue trace.

EXAMPLE 37

The following dispersion is prepared:

| | |
|---|---|
| Carbonate of dihydroxy 2,3 naphthalene | 9.6 g |
| crystal violet lactone | 0.5 g |
| Polyvinyl alcohol 10% by weight in water (Rhodoviol 4/125 P of the Societe Rhone-Poulenc company | 110 g |
| Zinc oxide | 8 g |

This composition is applied to a paper support in the ratio of 4 g per square meter.

One obtains a blue trace against a white background by recording with a heated point at 130° C.

EXAMPLE 38

One makes the following dispersion:

| | |
|---|---|
| Carbonate of dihydroxy 2,3 naphthalene | 3.2 g |
| 1'-isopropyl, 3',3'-dimethyl, 6-nitro,8-methoxy spiro (2H—1-benzopyran-2,2' indoline) | 0.95 g |
| Polyvinyl alcohol 10% by weight in water (Rhadoviol 4/20 of the Societe Rhone-Poulenc) | 15 g |
| Water | 10 g |

By operating as in the preceding example, one obtains a blue-violet trace.

EXAMPLE 39

One prepares the following compositions:

| | |
|---|---|
| Diethoxy 2,3 naphthalene | 8 g |
| Citric acid | 5 g |
| Thiourea | 10 g |
| Methyl ethyl ketone | 1 l |
| 4-diazo-2,5-dibutoxy phenyl morpholine Borofluoride | 20 g |

-continued

This composition is coated on a paper support in the ratio of 20 cubic meters to 1 square meter.

After exposure through an original, one obtains the following results:

| Example Number | Developer Used | Color of the Image |
|---|---|---|
| i | Heating to 150° C. for 10 sec. | Purple |
| ii | Passage into an ammonia development machine at a temperature of about 60° C. | Dark Purple |
| iii | Aqueous solution of triethylene diamine at 75 g/l | Light Purple |
| iv | Solution as in iii; then heating to 80° C. | Dark Purple |
| v | Aqueous solution containing thiourea 1 g/l metaborate of soda 1 g/l metaborate of potassium 5 g/l | Light Purple |
| vi | Aqueous solution as in v then heated to 80° C. for 4 seconds | Purple |
| vii | Aqueous solution with 10% by volume of monoethanolamine | Dark purple |
| viii | Heating to 110° C. for 10 seconds, with the paper support having a coating on its back of a mixture of ⅔ of ammonium sulfate and ⅓ of sodium bicarbonate by weight | Dark purple |

EXAMPLE 40

One makes the following dispersion:

| | |
|---|---|
| Dimethoxy 2,3 naphthalene | 0.7 g |
| crystal violet lactone | 0.1 g |
| Polyvinyl alcohol 10% by weight in water (Rhodoviol 4/125 P) | 9.5 g |

The coating is deposited at a rate of 5 g per square meter on a paper support.

One obtains a blue trace with the use of a point heated to 150° C.

EXAMPLE 41

One makes the following dispersion:

| | |
|---|---|
| 1',3',3'-trimethyl, 6-nitro, 8-methoxy spiro (2H—1 benzopyran 2,2' indoline) | 1.3 g |
| Diethoxy 2,3 naphthalene | 3.5 g |
| Polyvinyl alcohol 10% by weight in water (Rhodoviol 4/125 P) | 70 g |

One preceeds as in the preceding example to obtain a dark blue trace.

EXAMPLE 42

The spiropyran used in the formula of Example 41 is replaced by a stoichiometrically equivalent amount of 3'-methyl, 3-methyl, 6-nitro, 8-methoxy spiro (1-benzopyran, 2,2', benzothiazole). Under the same operating conditions as in Example 41, a trace of brown color is obtained.

I claim:

1. A recording or reproduction material comprising a support and a coating of a sensitive layer on said support, said sensitive layer containing, as essential color forming reactants, a chromogenic compound capable of reacting with a phenolic coupler compound to form a colored reaction product selected from the group consisting of spiropyram compounds, triarylmethane compounds, chromogenic ferric salts, non-photosensitive chromogenic silver salts and diazonium compounds, and a hydroxyl group-blocked phenolic coupler compound which is the reaction product of a phenolic coupler compound and a hydroxyl group reactive compound capable of replacing the hydrogen atom of each phenolic hydroxyl group of the phenolic coupler compound, the stabilized phenolic compound being non-reactive to the chromogenic compound and being capable of producing the phenolic coupler compound by decomposition in situ wherein the stablized phenolic coupler compound is a derivative of 2,3-dihydroxynaphthalene of the formula

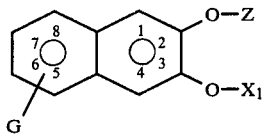

wherein

G represents a hydrogen atom, a sulfonic group or a sulfonate of ammonium or an amine and represented by the formula:

$[-SO_3^-, EH^+]$ in which E represents ammonia or a primary, secondary or tertiary aromatic or aliphatic amine; Z represents a radical of the following formula (IIa), (IIb), or (IIc)

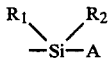

(IIa)

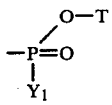

(IIb)

or $C_nH_{2n+1}$ (IIc)

wherein n is an integer of from 1 to 5 and when Z represents a radical of formula (IIa) then A is a radical $R_3$ selected from the group consisting of a straight or branched alkyl or alkenyl group of from 1 to 6 carbon atoms which may be substituted by at least one substituent selected from the group consisting of a chlorine atom, a nitrile group, phenyl and alkyl phenyl in which the alkyl has from 1 to 4 carbon atoms; and $X_1$ is a triorganosilyl radical of the formula

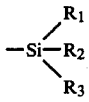

wherein $R_1$, $R_2$ and $R_3$ may be the same or different, and $R_1$ and $R_2$ have the same meaning as $R_3$; or $X_1$ and A may be linked together to form a divalent radical of the following formula (Va), (Vb) or (Vc):

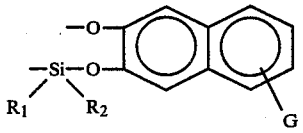

(Va)

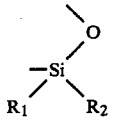

(Vb)

or

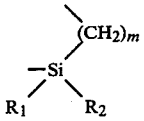

(Vc)

in which the silicon atom is linked to the oxygen atom at the 3-position of the naphthyl group; $R_1$ and $R_2$ may be the same or different and are as defined above, m is 1, 2 or 3 and G is as defined above, with the proviso that when there is more than one G group in the molecule they are identical; when Z represent a radical of formula (IIb) then $X_1$, $Y_1$ and T are defined according to (A), (B) or (C):

(A) $Y_1$ represents a radical OR in which R is branched or straight alkyl of from 1 to 8 carbon atoms or the group $[-O^-, EH^+]$ wherein E is as previously defined, T has the same meaning as R or ammonia, and $X_1$ is a radical of the formula:

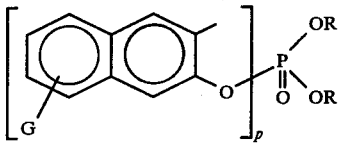

wherein p is 0, 1, 2 or 3 and G and R have the previously given definitions, with the provisos that when there is more than one G group in the molecule they are identical; when one OR group is an oxyammonium group the other OR group is identical and G is a hydrogen atom or a sulfonate group $-SO_3^-$, $EH^+$ with the $EH^+$ groups representing the identical radical;

(B) T is a radical $OR^1$ wherein $R^1$ is a hydrogen atom or the radical R as previously defined, and $Y_1$ and $X_1$ together form a divalent radical of the following formula:

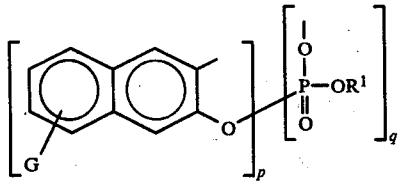

wherein p is 0, 1, 2 or 3, q is 0 or 1 and G and $R^1$ are as defined above, with the provisos that when q is 1, the atoms of phosphorous are bound by an oxygen atom; when p and q are both 0, $X_1$ and $Y_1$ form a valence link; when there is more than one G group in the molecule they are identical; all radicals $OR^1$ in the molecule are identical to each other and when $OR^1$ represents an oxyammonium group, the group G is a hydrogen atom or a sulfonate group $[-SO_3^-, EH^+]$ in which all $EH^+$ radicals are identical; or (C) T is a radical of the following formula ($IIb_3$)

($IIb_3$)

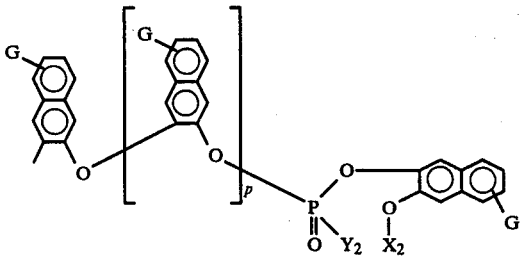

wherein p and G are as defined above;

$X_2$ and $Y_2$ together form a valency link; and $X_1$ and $Y_1$ form a valency link; or $Y_1$ and $Y_2$ together form a radical of the following formula ($IIb_4$)

($IIb_4$)

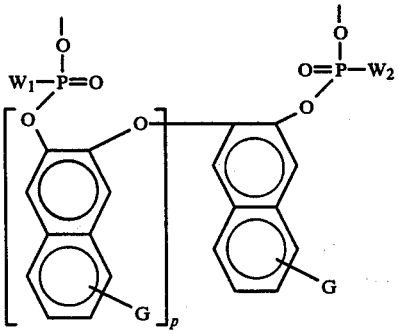

in which the groups $W_1$ and $X_1$ and $W_2$ and $X_2$ each represent a valency link; and when Z represents a radical of formula (IIc) then $X_1$ also represents the same radical of formula (IIc); or Z and $X_1$ together for the radical

>C=O.

2. The recording or reproduction material of claim 1 wherein the stablized phenolic compound is an organosilane ether of the phenolic coupler compound selected from the group consisting of:

(Ia)

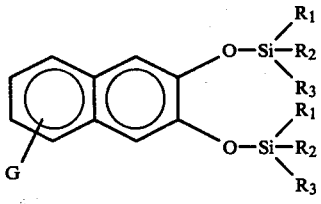

(Ib)

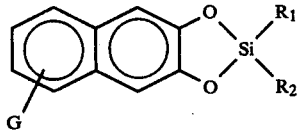

(Ic)

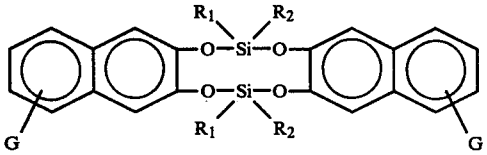

(Id)

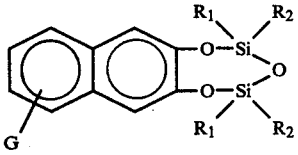

(Ie)

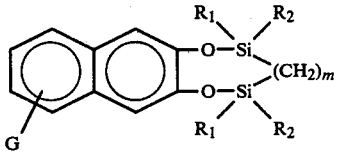

wherein G, $R_1$, $R_2$, $R_3$ and m have the previously given definitions.

3. The recording or reproduction material of claim 2 in which G is a hydrogen atom or a sulfonic group.

4. The recording or reproduction material of claim 2 in which G is a sulfonic group.

5. The recording or reproduction material of claim 2 in which $R_1$, $R_2$ and $R_3$ may be the same or different and represent hydrogen, methyl, ethyl, chloromethyl, cyanoethyl, phenyl or tolyl.

6. The composition of claim 1 wherein the stablized phenolic compound is an organophosphoric acid ester of the phenolic coupler compound selected from the group consisting of (If)

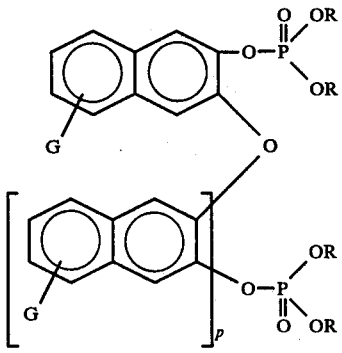

-continued (Ig)

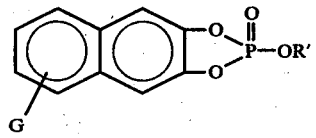

(Ih)

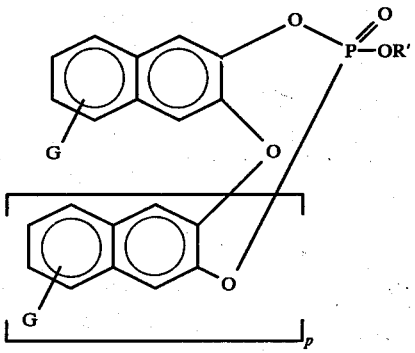

(Ii)

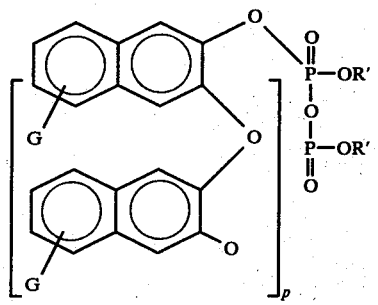

(Ij)

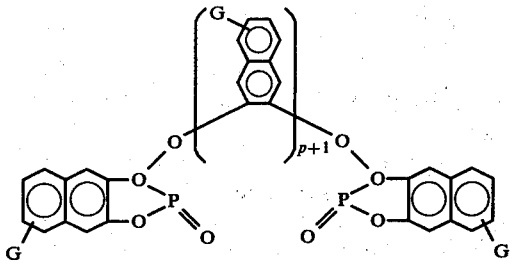

(Ij')

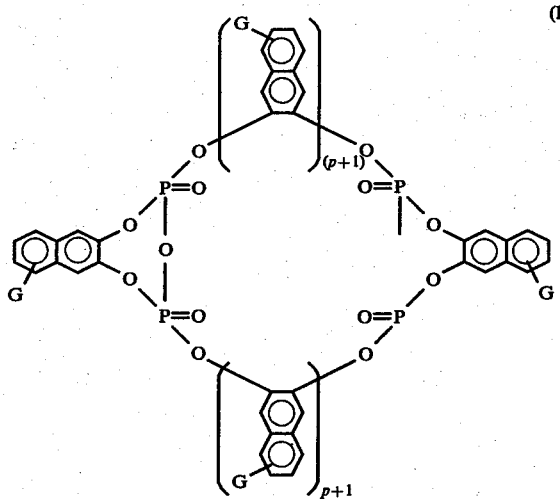

wherein G, R, R' and p have the previously given definitions.

7. The recording or reproduction material of claim 6 wherein the stablizied phenolic coupler compound has the formula (If) in which G is hydrogen or a sulfonic group and R is a straight or branched alkyl of 1 to 8 carbon atoms.

8. The recording or reproduction material of claim 6 wherein the stabilized phenolic coupler compound has the formula (If) in which G is hydrogen or a sulfonate group and OR is an oxyammonium.

9. The recording or reproduction material of claim 6 wherein the stabilized phenolic coupler compound has the formula (Ih), (Ii) or (Ig), in which G is hydrogen or sulfonic group and R' is a straight or branched alkyl group of 1 to 8 carbon atoms.

10. The recording or reproduction material of claim 6 wherein the stabilized phenolic coupler compound has the formula (Ih), (Ii), or (Ig), in which G is hydrogen or a sulfonate group and OR' is an oxyammonium radical.

11. The recording or reproduction material of claim 6 wherein the stabilized phenolic coupler compound has the formula (Ih), (Ii) or (Ig), in which G is hydrogen or a sulfonic group and OR' is a hydroxy (OH) group.

12. The recording or reproduction material of claim 6 wherein the stabilized phenolic coupler compound has the formula (Ij) or (Ij'), in which G is hydrogen or a sulfonic group.

13. The recording or reproduction material of claim 6 in which the stabilized phenolic coupler compound has the formula (Ij) or (Ij') in which G is a sulfonate group.

14. The recording or reproduction material of claim 1 in which the stabilized phenolic coupler compound has the formula

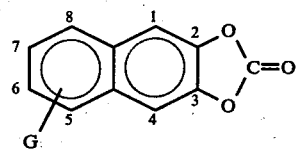

wherein G has the previously given meaning.

15. The recording or reproduction material of claim 1 in which the stabilized phenolic coupler compound has the formula

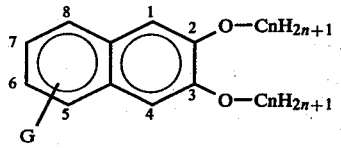

in which n is an integer of 1, 2, 3, 4 or 5, and G has the previously given meaning.

16. The recording or reproduction material according to claim 15 in which G is a sulfonate of the formula $$[-SO_3^-, EH^+]$$

wherein E is ammonia, tertiary aliphatic monoamine or tertiary aliphatic polyamine, with the groups attached to the nitrogen atom being alkyl, hydroxyalkyl or alkylene of from 1 to 6 carbon atoms.

17. The recording or reproduction material of claim 15 in which G is hydrogen.

18. The recording or reproduction material of claim 15 in which G is the sulfonic group or the sulfonate group and is placed at the 6-position of the naphthyl ring.

19. The recording or reproduction material according to claim 14 in which G is a sulfonate of the formula $$-SO_3^-, EH^+]$$

wherein E is ammonia, tertiary aliphatic monoamine or tertiary aliphatic polyamine, with the groups attached to the nitrogen atom being alkyl, hydroxyalkyl or alkylene of from 1 to 6 carbon atoms.

20. The recording or reproduction material of claim 14 in which G is hydrogen.

21. The recording or reproduction material of claim 14 in which G is the sulfonic group or the sulfonate group and is placed at the 6-position of the naphthyl ring.

22. The recording or reproduction material of claim 1 in which the ratio by weight between the chromogenic compound and the stabilized phenolic coupler compound is in the range of from 0.01 to 1 and 10 to 1.

23. The recording or reproduction material of claim 1 in which the ratio by weight between the chromogenic compound and the stabilized phenolic coupler compound is in the range of from 0.05 to 1 and 3 to 1.

* * * * *